US008712277B2

(12) United States Patent
Ooyoshi

(10) Patent No.: US 8,712,277 B2
(45) Date of Patent: Apr. 29, 2014

(54) ROTATING-BODY ELECTRIFICATION MECHANISM, IMAGE CARRIER UNIT, PROCESS CARTRIDGE, IMAGE FORMING APPARATUS, AND METHOD FOR ELECTRIFYING IMAGE CARRIER UNIT

(75) Inventor: Hirobumi Ooyoshi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 176 days.

(21) Appl. No.: 13/363,844

(22) Filed: Feb. 1, 2012

(65) Prior Publication Data

US 2012/0213544 A1 Aug. 23, 2012

(30) Foreign Application Priority Data

Feb. 17, 2011 (JP) ..... 2011-032429

(51) Int. Cl.
*G03G 15/00* (2006.01)

(52) U.S. Cl.
USPC ..... 399/90

(58) Field of Classification Search
USPC ..... 399/90
See application file for complete search history.

(56) References Cited

U.S. PATENT DOCUMENTS

| | | | | |
|---|---|---|---|---|
| 4,561,763 | A * | 12/1985 | Basch | 399/116 |
| 4,839,690 | A * | 6/1989 | Onoda et al. | 399/117 |
| 4,975,744 | A * | 12/1990 | Ebata et al. | 399/90 |
| 5,283,619 | A * | 2/1994 | Nomura et al. | 399/90 |
| 5,752,136 | A * | 5/1998 | Sanchez et al. | 399/117 |
| 5,845,173 | A * | 12/1998 | Zogg et al. | 399/90 |
| 6,771,915 | B2 * | 8/2004 | Cais et al. | 399/90 |
| 8,254,801 | B2 * | 8/2012 | Zogg | 399/90 |
| 2002/0018666 | A1 * | 2/2002 | Noda et al. | 399/90 |
| 2003/0142991 | A1 * | 7/2003 | Arimitsu et al. | 399/90 |
| 2003/0194248 | A1 * | 10/2003 | Anderson, II | 399/90 |
| 2005/0214018 | A1 * | 9/2005 | Hale et al. | 399/90 |
| 2006/0110180 | A1 * | 5/2006 | Guy et al. | 399/90 |

FOREIGN PATENT DOCUMENTS

| | | |
|---|---|---|
| JP | 5-297782 | 11/1993 |
| JP | 11-249495 | 9/1999 |
| JP | 2000-48873 | 2/2000 |
| JP | 2001-75423 | 3/2001 |
| JP | 2002-62759 | 2/2002 |
| JP | 2004-77913 | 3/2004 |
| JP | 3575443 | 7/2004 |
| JP | 3877268 | 11/2006 |
| JP | 2007-57945 | 3/2007 |
| JP | 3938273 | 4/2007 |
| JP | 3950635 | 4/2007 |
| JP | 2008-54713 | 3/2008 |

* cited by examiner

*Primary Examiner* — G. M. Hyder
(74) *Attorney, Agent, or Firm* — Oblon, Spivak, McClelland, Maier & Neustadt, L.L.P.

(57) ABSTRACT

According to an embodiment, there is provided a mechanism for electrification of a rotating body used in an image forming apparatus. In the mechanism, compression of an elastically-deformable pressing member brings a portion of a cloth-like or sheet-like conductive member into contact with an electrification object and presses the rest of the conductive member against a conductive contact member, which is any one of the rotating body, a rotating shaft that rotates together with the rotating body, and a shaft that rotatably supports the rotating body. A connecting between the electrification object and the contact member is achieved via the conductive member.

15 Claims, 22 Drawing Sheets

ROTATING-BODY ELECTRIFICATION MECHANISM, IMAGE CARRIER UNIT, PROCESS CARTRIDGE, IMAGE FORMING APPARATUS, AND METHOD FOR ELECTRIFYING IMAGE CARRIER UNIT

CROSS-REFERENCE TO RELATED APPLICATIONS

The present application claims priority to and incorporates by reference the entire contents of Japanese Patent Application No. 2011-032429 filed in Japan on Feb. 17, 2011.

BACKGROUND OF THE INVENTION

1. Field of the Invention

The present invention relates to: a mechanism for electrification (e.g., grounding) of a rotating body used in any of an electrophotographic image forming apparatus, an electrostatic-recording image forming apparatus, and a magnetic-recording image forming apparatus; an image carrier unit, a process cartridge, and an image forming apparatus using the mechanism for the rotating body; and a method for electrifying (e.g., grounding) an image carrier unit.

2. Description of the Related Art

There have been proposed technologies for electrification, such as grounding, using a conductive cloth or static eliminating cloth having the conductive property and flexibility, a conductive sheet, or a metal leaf spring in a mechanism for electrification, such as grounding, of a rotating body used in an electrophotographic image forming apparatus, such as a copier, a facsimile machine, a printer, a plotter, or a multifunction peripheral having a plurality of such functions (for example, see Japanese Patent Application Laid-open No. 2000-48873, Japanese Patent Application Laid-open No. 2007-57945, Japanese Patent Application Laid-open No. H11-249495, Japanese Patent No. 3950635, and Japanese Patent No. 3938273).

Japanese Patent Application Laid-open No. 2000-48873 discloses a grounding device for a conductive rotary shaft that is used in a sheet conveying apparatus. The grounding device includes a grounding unit having a core made of an elastic material and a conductive material (a cloth, hereinafter referred to as a "conductive cloth") formed around the core. A conductive surface of the grounding unit is biased against the surface of the conductive shaft that is rotating, and another conductive surface of the grounding unit is brought into contact with a conductive member that is electrically connected to the grounded frame of the main body of the grounding device, so that the conductive shaft that is rotating is grounded.

Japanese Patent Application Laid-open No. 2007-57945 discloses a technique of achieving the grounding by the use of a static eliminating member, which is provided near a transfer unit to eliminate the static of a recording medium. The static eliminating member uses a static eliminating cloth (conductive cloth) made of a sheet-like conductive fiber aggregate as a base material. The static eliminating cloth is attached to a member and comes into press contact with the member while it is moved in synchronization with the member, so that grounding is achieved.

Japanese Patent Application Laid-open No. H11-249495 discloses a structure including a shaft contact spring (first leaf spring) of a drum grounding plate that comes into contact with an electrical connection shaft by which a photosensitive drum (cylindrical member) is rotatably supported, and two or more grounding spring contact parts (second leaf springs) of cylinder springs and that come into contact with an inner wall of the photosensitive drum, in which the electrical connection shaft and the inner wall of the photosensitive drum are electrically connected to each other (see FIGS. 4 and 20 to 24 of Japanese Patent Application Laid-open No. H11-249495).

Japanese Patent No. 3950635 discloses a static eliminator for a paper conveying apparatus which grounds the static generated from triboelectric charge between a roller and paper and in which a rotary shaft, which supports a paper conveying roller, is supported in a freely rotatable manner at the both ends by supporting members. In this technique, a conductive member for grounding contacts a portion of the peripheral surface of the rotary shaft (which includes an outer circumferential surface and an end face) via a static eliminating cloth, a conductive lubricant is applied to the surface of the static eliminating cloth that faces the rotary shaft made of a metal, and the surface of the conductive member for grounding, on which the static eliminating cloth is attached, has an exposed opposing surface where the conductive member for grounding does not contact the rotary shaft made of a metal (see FIGS. 2, 3, and 6 of Japanese Patent No. 3950635).

Japanese Patent No. 3938273 discloses a technology for conduction between a base and a support shaft in a photoreceptor; as shown in FIGS. 2 and 6, etc. of this patent document, in the photoreceptor, which includes a cylindrical conductive base with a photosensitive layer on the surface and an insulating flange press-fitted into the edge of the base and is configured to rotate around a metal support shaft attached to the center of the flange, a conductive member made of a conductive short fiber assembly is held between grounding plates with a guide hole bigger than a shaft hole made on the flange in the center and a plurality of contactors in contact with the inner surface of the base along the periphery, and the conductive member held between the grounding plates is fixed to the flange so as to bring the contactors into contact with the inner surface of the base, and an elastic plate-like pressing member is attached to a surface of the conductive member on the side opposite to a surface in contact with the support shaft, and then the tip of the conductive member fixed to the flange is brought into contact with the surface of the support shaft, thereby achieving conduction between the base and the support shaft.

However, in the technique disclosed in Japanese Patent Application Laid-open No. 2000-48873, the conductive shaft is pressed against the conductive cloth from above in a vertical direction by the weight of the conveying roller including the conductive shaft, so that electrical connection, e.g., grounding is achieved. Flexibility of the conductive cloth is not actively used in this technique.

In the technique disclosed in Japanese Patent Application Laid-open No. 2007-57945, the static eliminating cloth is attached to a member and comes into press contact with the member by being moved in synchronization with the member. Accordingly, flexibility of the conductive cloth is not actively used like in Japanese Patent Application Laid-open No. 2000-48873.

In the technique disclosed in Japanese Patent Application Laid-open No. 11-249495, a conductive cloth is not used and the electrical connection shaft made of a metal and the first leaf spring, which is also a metal member, slide on each other, so that abrasion occurs on either one or both of the members. For this reason, there have been problems, such as abnormal sound caused by abrasion, poor electrical connection caused by the oxidation of metal, and a large load caused by press contact. As measures against the sliding between metals, a conductive lubricant may be used to solve the above-mentioned problems. However, a conductive lubricant is scraped off at a contact point between metal members as sliding is done many times. Accordingly, although a conductive lubricant is a very effective measure at the early stage of sliding, it is not the fundamental solution.

Since an office machine, which is an electrophotographic image forming apparatus, such as a copying machine, a facsimile, or a printer, is used indoors, it is particularly required that no noise, no abnormal sound, is generated.

Also in the technology disclosed in Japanese Patent No. 3950635, as in Japanese Patent Application Laid-open No. 2000-48873, Japanese Patent Application Laid-open No. 2007-57945, and Japanese Patent Application Laid-open No. H11-249495, the flexibility of the conductive cloth is not actively utilized.

In the technology disclosed in Japanese Patent No. 3938273, as shown in FIG. 2, the conductive member (a conductive cloth) is bent by means of the flexibility so as to be in contact with the support shaft (a shaft) of the photoreceptor, however, it is a configuration that the shaft is inserted into the flange attached with the conductive cloth from outside to inside of the flange.

There is a need to achieve and provide a mechanism for electrification (grounding) of a rotating body used in any of an electrophotographic image forming apparatus, an electrostatic-recording image forming apparatus, and a magnetic-recording image forming apparatus, an image carrier unit, process cartridge, and image forming apparatus using the mechanism, and a method for electrifying the image carrier unit that are capable of resolving the above problems caused by sliding between metals and eliminating application of conductive lubricant in a simple, inexpensive, environmentally-friendly manner.

SUMMARY OF THE INVENTION

It is an object of the present invention to at least partially solve the problems in the conventional technology.

According to an embodiment, there is provided a mechanism for electrification of a rotating body used in an image forming apparatus. In the mechanism, compression of an elastically-deformable pressing member brings a portion of a cloth-like or sheet-like conductive member into contact with an electrification object and presses the rest of the conductive member against a conductive contact member, which is any one of the rotating body, a rotating shaft that rotates together with the rotating body, and a shaft that rotatably supports the rotating body. A connecting between the electrification object and the contact member is achieved via the conductive member.

According to another embodiment, an image carrier unit has the mechanism mentioned above. The conductive member has at least any one of a slit and a cutout portion that enables the contact member to penetrate through the conductive member and enables the conductive member to bend and be in contact with the contact member when the contact member penetrates through the conductive member. The rotating body includes an image carrier with any one of an electrophotographic photosensitive layer, an electrostatic recording dielectric layer, and a magnetic recording magnetic layer on a cylindrical conductive base material. The image carrier unit includes: a flange member that is fixed to at least one end of the image carrier; and a metal conductive member a base end portion of which is in contact with the conductive member and a tip portion of which is fixed to an inner wall surface of the conductive base member, and is configured to enable the contact member to penetrate therethrough without making contact, wherein the conductive shaft penetrates through the center of the flange member, thereby rotatably supporting the image carrier, the pressing member, the conductive member, and the metal conductive member are placed within the flange member in this order from inside, and the metal conductive member is fixed to the inside of the flange member with the pressing member and the conductive member sandwiched therebetween, the shaft is inserted into the metal conductive member, the conductive member, the pressing member, and the flange member, thereby the conductive member bends and comes in contact with the shaft by compression of the pressing member, and the conductive base member is connected to the shaft through contact between the metal conductive member and the conductive member.

According to still another embodiment, a process cartridge integrally holds therein an image carrier and at least any one of a charging unit, a cleaning unit, and a developing unit and is removably attached to a main body of an image forming apparatus. The process cartridge includes the image carrier unit mentioned above.

According to still another embodiment an image forming apparatus includes: the image carrier unit or the process cartridge mentioned above.

According to still another embodiment, a method for electrifying an image carrier unit is provided. The image carrier includes: an image carrier with any one of an electrophotographic photosensitive layer, an electrostatic recording dielectric layer, and a magnetic recording magnetic layer on a cylindrical conductive base material; an insulating flange member fixed to at least one end of the image carrier; a conductive shaft that penetrates through a center of the flange member, thereby rotatably supporting the image carrier; a cloth-like or sheet-like conductive member through which the shaft penetrates; a metal conductive member of which base end portion is in contact with the conductive member and of which tip portion is fixed to an inner wall surface of the conductive member, and is configured to enable a contact member to penetrate therethrough without making contact; and an elastically-deformable pressing member through which the shaft can penetrate. The method includes: placing the pressing member, the conductive member, and the metal conductive member inside the flange member in this order from inside; inserting the shaft into the metal conductive member, the conductive member, the pressing member, and the flange member thereby bending the conductive member and also compressing the pressing member thereby bringing the conductive member into contact with the shaft; and connecting the conductive member to the shaft via contact between the metal conductive member and the conductive member so as to be electrically conductive.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
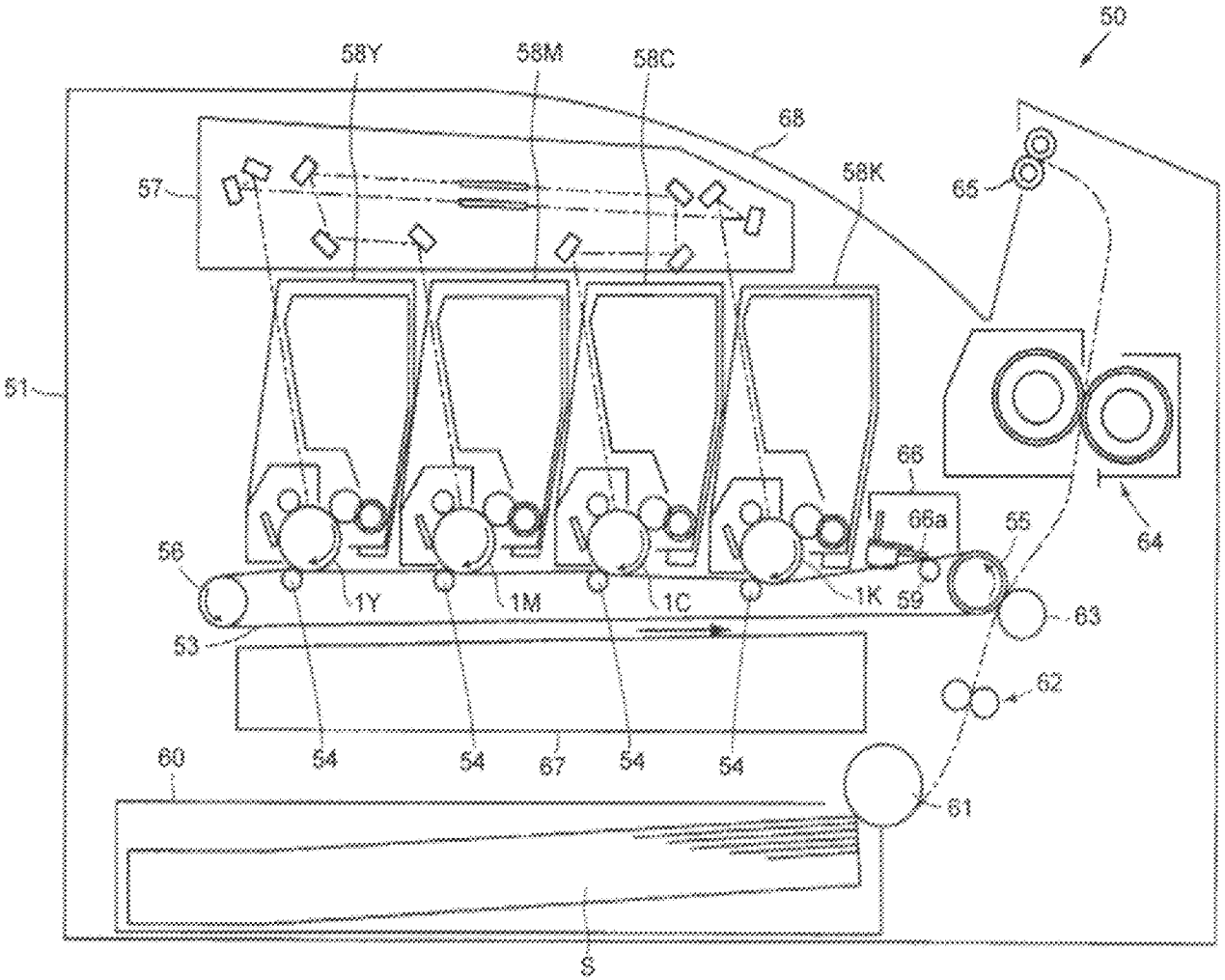
FIG. 1 is a schematic configuration diagram of an entire color image forming apparatus according to a comparative example.

Exemplary embodiments including examples will be explained below with reference to accompanying drawings. Elements (members or components) having the same function and shape, etc. among a comparative example, a reference example, and embodiments shall be denoted by the same reference numeral only if there is no possibility of a confusion of them. For simplicity of drawings and description, an element supposed to be illustrated in a drawing may be arbitrarily omitted without any explanation if the element does not have to be particularly described in the drawing.

First, the overall configuration and operation of an electrophotographic color image forming apparatus 50 according to an embodiment is explained with reference to FIG. 1. FIG. 1 is a schematic cross-sectional view showing an internal configuration of the color image forming apparatus 50.

As shown in FIG. 1, roughly in the center of a main body frame 51 of the color image forming apparatus 50, four process cartridges 58K, 58C, 58M, and 58Y as process cartridges composing an image forming unit are arranged in parallel in this order from right to left. Above the process cartridges 58K, 58C, 58M, and 58Y, as a latent-image forming unit and an exposure unit, an exposure device 57 for forming different latent images on image carriers 1K, 1C, 1M, and 1Y is placed. In the example shown in FIG. 1, the image carriers 1K, 1C, 1M, and 1Y are each composed a photoreceptor; a black (K) toner image, a cyan (C) toner image, a magenta (M) toner image, and a yellow (Y) toner image are formed on the surfaces of the respective photoreceptors.

The process cartridges 58K, 58C, 58M, and 58Y have the same configuration except that they differ in color of toner used therein as developer and a toner image formed therein; therefore, hereinafter, when the process cartridges 58K, 58C, 58M, and 58Y are explained as a whole, they are referred to as the process cartridge 58 without an alphabetic code indicating the color. Likewise, when the image carriers 1K, 1C, 1M, and 1Y are explained as a whole, they are referred to as an image carrier 1 without an alphabetic code indicating the color.

As shown in detail in FIGS. 1 and 2, each process cartridge 58 includes an image carrier unit 10 that includes the image carrier 1 and the like as described below, a charging roller 11 constituting a charging device as a charging unit, a cleaning blade 13 constituting a cleaning device as a cleaning unit, and a frame 14 as a casing-like support member that integrally supports a developing roller 12 constituting a developing device as a developing unit. Each process cartridge 58 is detachably mounted on the main body frame 51 of the color image forming apparatus 50 via the frame 14. The frame 14 includes a pair of support side plates (not shown) that are disposed on the front and rear sides of the plane of FIG. 2.

The charging roller 11 comes into press contact with the outer peripheral surface of the image carrier 1. Accordingly, while the charging roller is rotated by the rotation of the image carrier 1, a DC bias or a bias where an AC bias is superimposed on a DC bias is applied to the charging roller by a high-voltage power source (not shown). As a result, the image carrier 1 is charged to a uniform surface potential (for example, −200 to −1000 V).

The developing device, which includes the developing roller 12 and the like, is a one-component contact developing unit, and an electrostatic latent image formed on the image carrier 1 is developed into a toner image by a predetermined developing bias supplied from a high-voltage power source (not shown).

An endless intermediate transfer belt 53 as an intermediate transfer body, which carries and conveys a toner image as a transfer image, is disposed below the process cartridges 58. The intermediate transfer belt 53 is stretched by a plurality of rotary members, that is, a driving roller 55 also serving as a secondary transfer opposite roller, a cleaning opposite roller 59 made of metal, primary transfer rollers 54, and a driven roller 56 also serving as a tension roller. The intermediate transfer belt is rotationally driven in a direction of an arrow in the drawing via the driving roller 55 by a driving motor (not shown) serving as a driving unit that is connected to the driving roller 55 via a driving force transmitting unit, such as a gear or a belt. Among the plurality of rotary members, the driving roller 55 is a driving rotary member and the driven roller 56 is a driven rotary member.

Meanwhile, bearing parts, which are provided at both ends of the driven roller 56, are pressurized by springs (not shown), so that belt tension applied to the intermediate transfer belt 53 is generated. The respective rollers, which stretch the intermediate transfer belt 53, are supported on both sides of the intermediate transfer belt 53 by a pair of side plates (not shown) of an intermediate transfer belt unit.

An endless belt of a resin film form that is obtained by dispersing a conductive material such as carbon black in PVDF (polyvinylidene fluoride), ETFE (ethylene-tetrafluoroethylene copolymer), PI (polyimide), PC (polycarbonate), TPE (thermoplastic elastomer), or the like is used as the intermediate transfer belt 53.

The primary transfer rollers 54, which form a primary transfer device, are disposed below the positions where the image carriers 1 of the process cartridges 58 come into contact with the intermediate transfer belt 53. A conductive blade, a conductive sponge roller, a metal roller, or the like may be used as the primary transfer roller 54. However, a metal roller is used as the primary transfer roller in this embodiment, and the primary transfer roller is disposed so as to be offset from the image carrier 1 in the moving direction of the intermediate transfer belt 53 and in a vertical direction. When a predetermined transfer bias (for example, +500 to +1000 V) is commonly applied to the primary transfer rollers 54 by a single high-voltage power source (not shown), transfer electric fields are formed on the image carriers 1 through the intermediate transfer belt 53 and a potential difference is generated between the image carriers 1 and the intermediate transfer belt 53. Accordingly, monochrome toner images corresponding to respective colors, which are formed on the surfaces of the image carriers 1, are transferred to the intermediate transfer belt 53.

These monochrome toner images corresponding to the respective colors are sequentially transferred to the intermediate transfer belt 53 by the respective process cartridges 58. Accordingly, a color toner image having a plurality of colors, which is formed by superimposing the monochrome toner images, is formed on the intermediate transfer belt 53.

A sheet feed cassette 60 of a sheet feeding device, in which transfer materials such as paper or OHP sheets or sheet-like recording media (hereinafter, referred to as "sheets") S are stacked and received, is disposed below the intermediate transfer belt 53. The sheets S are separated and fed one by one by a sheet separating unit (not shown) and a sheet feed roller 61 of the sheet feeding device, passes between the intermediate transfer belt 53 and a secondary transfer roller 63 serving as a secondary transfer device by the driving roller 55 and is guided to a fixing device 64. Accordingly, the toner image is fixed to the sheet S by heat and pressure.

The sheet S fed from the sheet feed roller 61 is temporarily stopped at resist rollers 62 serving as resist means, and the sheet is aligned. After that, when the front end portion of the monochrome or color toner image formed on the surface of the intermediate transfer belt 53 reaches a secondary transfer position, the sheet is fed to the secondary transfer roller 63. When a high potential is applied to the secondary transfer roller 63 and there is a potential difference between the intermediate transfer belt 53 and the secondary transfer roller 63, the monochrome or color toner image formed on the intermediate transfer belt 53 is transferred to the sheet S.

Meanwhile, a roller, which is obtained by coating a metal core that has a diameter of, for example, 6 mm and is made of SUS or the like with an elastic body of a conductive material is used as the secondary transfer roller 63. For example, an electronically conductive roller, a conductive roller made of EPDM, or the like is used as the secondary transfer roller 63.

A sheet S to which an unfixed toner image has been transferred is released from the intermediate transfer belt 53 due to the curvature of the driving roller (secondary transfer opposite roller) 55 disposed on a longitudinal sheet feed path, and the toner image is melted and fixed to the sheet S by the fixing device 64. Then, the sheet is ejected and discharged to a sheet discharge tray 68, which is provided on the upper surface of the main body frame 51, by a sheet discharge roller 65 of a sheet discharge device.

Surplus toner, which remains on the surface of the intermediate transfer belt 53 from which the toner image has been transferred to the sheet S, is scraped by a cleaning blade **66*a* of an intermediate transfer body cleaning device 66 so that the intermediate transfer belt is cleaned. Then, the scraped toner is recovered by a toner recovery device 67 by way of a toner conveying path (not shown). The cleaned intermediate transfer belt 53** gets ready for the transfer of the next toner image.

Meanwhile, for example, urethane rubber is used as a material of the cleaning blade **66*a*, and the cleaning blade comes into counter contact with the intermediate transfer belt 53. It is preferable to prevent the blade from being turned up by applying a lubricant to at least either of a portion of the intermediate transfer belt 53 corresponding to a cleaning nip portion and an edge portion of the cleaning blade 66*a*** during the assembly work, and to improve cleaning performance by forming a dam layer at the cleaning nip portion.

Since a sheet conveying path, from the feeding of the sheet S to the discharge of the sheet, is simplified as much as possible and the radius of curvature of the sheet conveying path is increased as shown in FIG. 1, the color image forming apparatus 50 may prevent a sheet jam during the conveyance of a sheet and improve reliability. Further, the color image forming apparatus 50 is configured to allow an easy operation in removing a sheet jam when the sheet jam occurs and to be applied to a multi-purpose color electrophotographic device using various kinds of recording media, for example, thick paper.

In this embodiment, the sheet conveying path is formed to have a substantially circular arc shape. The intermediate transfer belt 53, the process cartridges 58, and the exposure device 57 are disposed on the inner side of the sheet conveying path. Accordingly, a space in the main body frame 51 is effectively used, which allows size reduction of the apparatus. In addition, the sheet conveying path is simplified, and the sheet S is ejected with the image-formed surface down.

According to the above-mentioned structure, the sheet conveying path may be simplified and almost all of the units are disposed on the inner side of the sheet conveying path, so that the sheet conveying path becomes closer to the main body frame 51 that is disposed at a relatively outer portion of the image forming apparatus. Accordingly, since the sheet conveying path is easily opened, an operation of removing a sheet jam is also easily performed when the sheet jam occurs. Further, since the sheet S is ejected to the sheet discharge tray 68 provided on the upper surface of the main body frame 51 in a posture in which the image-formed surface faces downward, when the sheets S stacked on the sheet discharge tray 68 are taken out, the image-formed surfaces of the sheets S face upward. This is advantageous in that the sheets are arranged in the printing order from the top to the bottom in the stack.

Furthermore, it is configured such that the right-hand side of FIG. 1 is the front side, an openable cover unit (not shown) is provided on the right side of the substantially middle of the sheet conveying path, and the sheet conveying path may be exposed to the outside when the cover unit is opened. Accordingly, an operation of removing a sheet jam is also more easily performed when the sheet jam occurs.

An electrophotographic image forming process will be described below. FIG. 2 is a cross-sectional view of the process cartridge 58.

Figure 2:
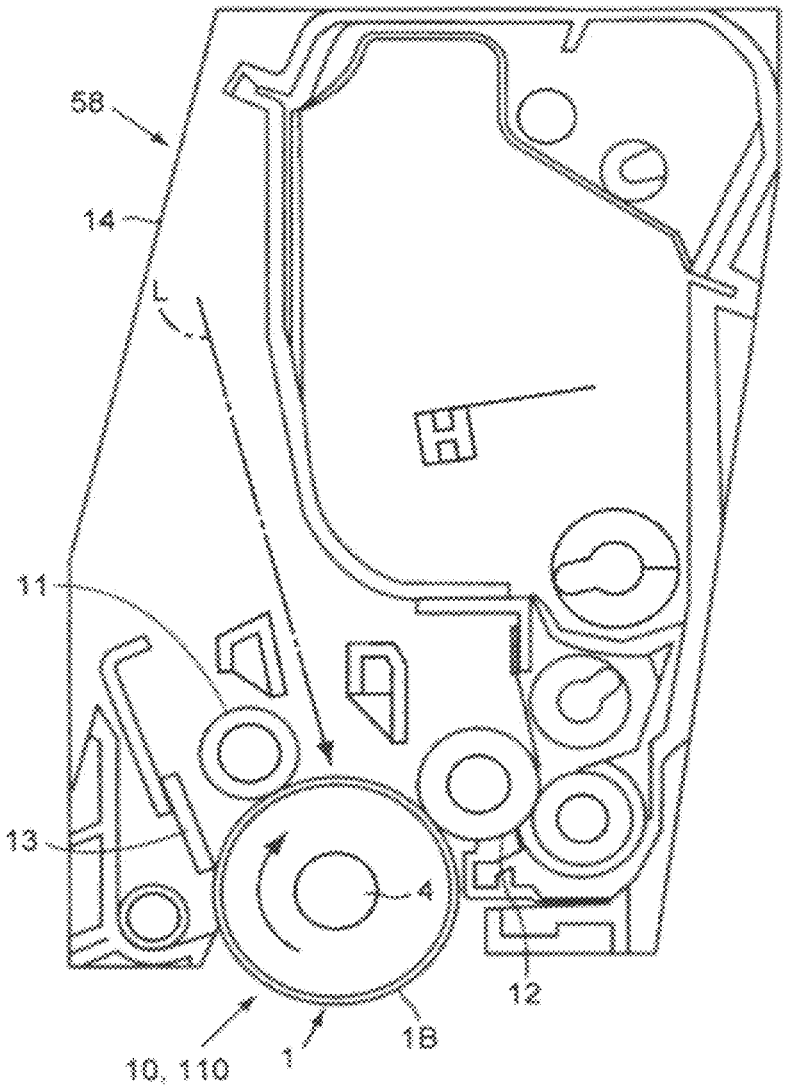
FIG. 2 is a cross-sectional view of a main part of a process cartridge according to the first embodiment.

In FIGS. 1 and 2, the image carrier 1 has a cylindrical shape and is rotationally driven in a direction of an arrow of FIG. 2 by a driving unit (not shown) provided in the main body frame 51, and a photosensitive layer 1B formed on the surface of the image carrier is charged uniformly to a high potential by the charging roller 11. The uniformly charged photosensitive layer 1B is exposed to a light beam (for example, laser light) L based on the image information output from the exposure device 57 that is the latent image forming means. An electrostatic latent image is formed on the photosensitive layer 1B by this exposure. The electrostatic latent image including a low potential portion with a reduced potential and a high potential portion resulting from initializing is formed in the photosensitive layer 1B. Subsequently, when the low potential portion (or the high potential portion) of the electrostatic latent image reaches a position where the image carrier 1 faces the developing roller 12, toner is moved to the image carrier 1 from the developing roller 12 that carries a thin toner layer on the surface thereof. Accordingly, a toner image (visible image) as a transferable image is formed on the surface of the image carrier 1. When the image carrier 1 rotates, the toner image is transferred to the intermediate transfer belt 53 by the primary transfer roller 54 shown in FIG. 1. In this case, residual toner, which is left after the transfer, that is, which is not transferred to the intermediate transfer belt 53, is present on the image carrier 1. However, the residual toner is removed from the image carrier 1 by the cleaning blade 13. A static eliminator (not shown) is provided on the downstream side of the cleaning blade 13 in the rotational direction of the image carrier 1. Residual charges on the surface of the image carrier 1 are removed by the static eliminator. Since the charging roller 11 is provided on the downstream side of the static eliminator in the rotational direction of the image carrier 1, the image carrier 1 is charged uniformly again to a high potential by the charging roller 11.

Comparative Example

Figure 3:
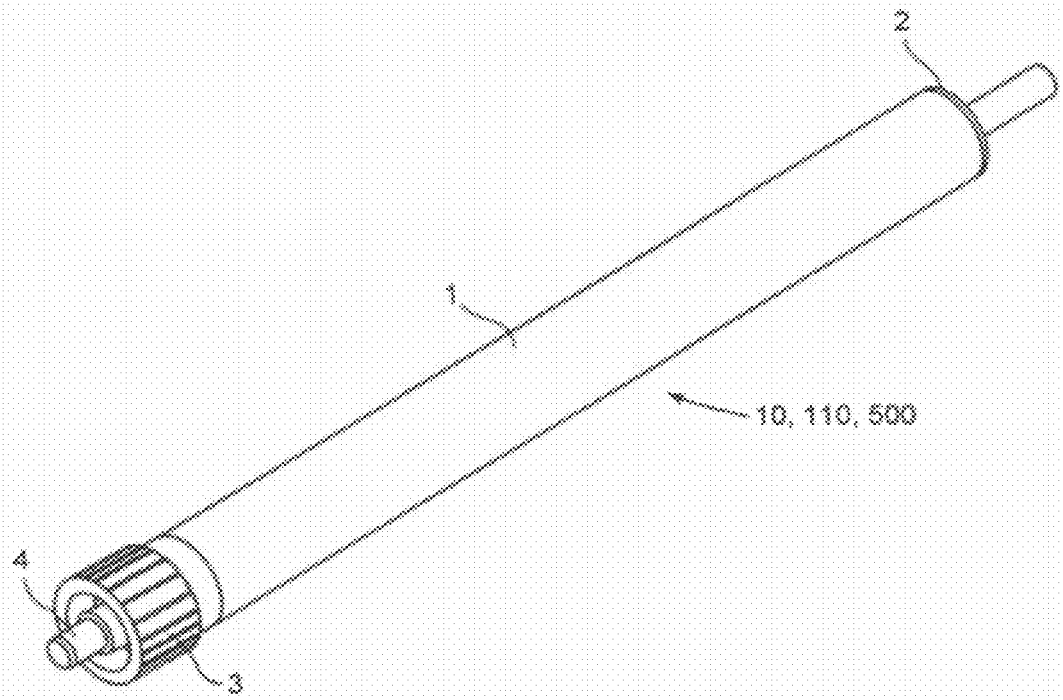
FIG. 3 is an external perspective view of an image carrier unit according to the first embodiment.
Figure 5:
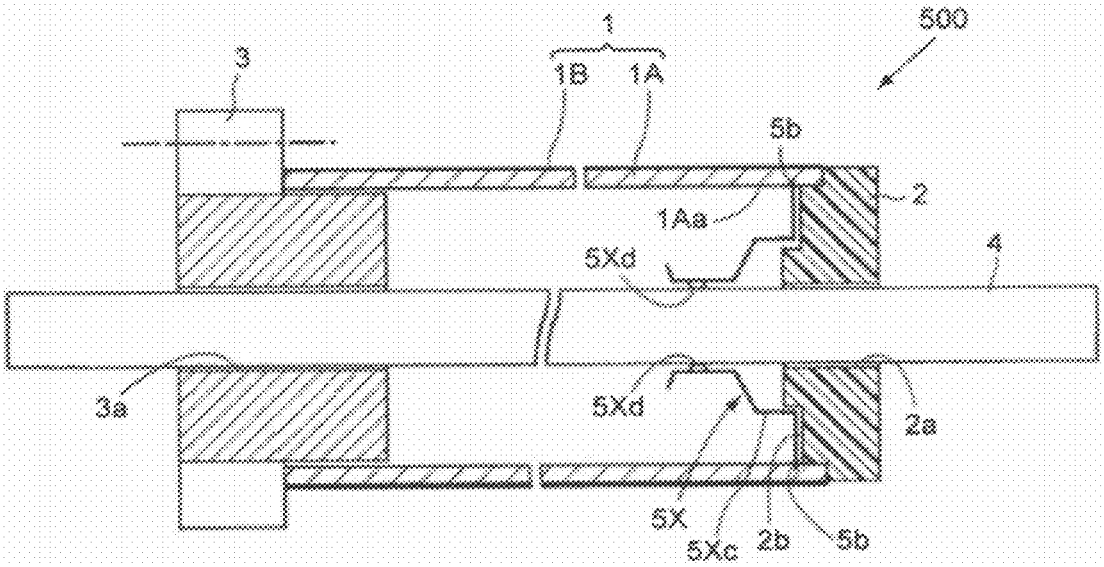
FIG. 5 is a cross-sectional view of one end portion of an image carrier unit according to a comparative example along the longitudinal (axial) direction.
Figure 6:
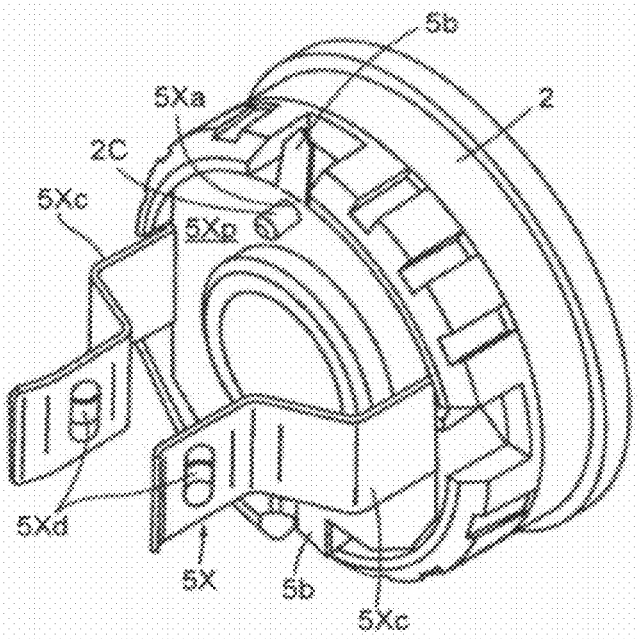
FIG. 6 is an external perspective view of a portion around a flange and a grounding plate in the image carrier unit according to the comparative example.

First, a comparative example is explained with reference to FIGS. 3, 5, and 6. FIG. 3 is an external perspective view of a general image carrier unit. FIG. 5 is a cross-sectional view of both end portions of an image carrier unit 500 along a longitudinal direction (an axial direction), and shows the respective shapes and arrangement of the image carrier 1, a flange 2, and a grounding plate 5X. FIG. 6 is a perspective view showing a state where the grounding plate 5X is mounted on the flange 2 before thermal caulking.

The image carrier unit 10 according to embodiments to be described later, an image carrier unit 110 according to a reference example to be described later, and the image carrier unit 500 according to the comparative example are the same in external appearance; as shown in FIG. 3, the image carrier unit is composed of the image carrier 1, the flange 2, a gear 3, and a shaft 4. The image carrier 1 is composed of a photoreceptor including a cylindrical conductive base member 1A and a photosensitive layer 1B formed on the surface of the conductive base member 1A. The flange 2 is provided as a flange member, and is attached/fixed to one end of the image carrier 1. The gear 3 is attached/fixed to the other end of the image carrier 1. The shaft 4 is provided as a contact member, and penetrates through the center of the flange 2 and the gear 3, thereby rotatably supporting the image carrier 1.

In the present comparative example, there is described a configuration example using a metal contact, in which conduction between two components of the image carrier unit 500, i.e., the conductive base member 1A of the image carrier (photoreceptor) 1 and the shaft 4 is made by a conventional grounding plate with reference to FIGS. 5 and 6.

As shown in FIGS. 5 and 6, the grounding plate 5X has two pressure contact portions 5*b*, two holes 5Xa (although only the upper hole 5Xa can be seen in FIG. 6, the unseen lower long hole is just hidden) formed on a flat plate portion 5Xp, two folded portions 5Xc, and two contact portions 5Xd, and is integrally formed of a thin plate, such as a spring material with a thickness of 0.1 to 0.2 mm, made of phosphor bronze, stainless steel, or the like. The grounding plate 5X is mounted on an inner wall of the flange 2 with avoiding a pipe-like portion on the inner side of the flange 2 so that the flat plate portion 5Xp has no contact with the shaft 4. The pressure contact portion 5*b* is pressed against (substantially fixed to) the conductive base member 1A by an elastic force of a spring as if the pressure contact portion 5*b*, which extends from the flat plate portion 5Xp in a radial direction of the conductive base member 1A, were partly biting into an inner wall 1Aa of the conductive base member 1A.

The grounding plate 5X is positioned in a three-dimensional direction and fixedly mounted on a mounting surface 2*b* of the flange 2 in such a manner that two bosses 2*c* (although only the upper boss 2*c* can be seen in FIG. 6, the unseen lower boss is just hidden) planted in the mounting surface 2*b* of the flange 2 are inserted into the two holes 5Xa, and after that, for example, the heads of the bosses 2*c* are processed with thermal caulking. The projection-like contact portion 5Xd is formed on the tip of each folded portion 5Xc folded from the flat plate portion 5Xp along a length direction of the shaft 4, and the contact portions 5Xd bend and have sliding contact with the outer circumferential surface of the shaft 4. The inner wall of the conductive base member of the image carrier 1 and the shaft 4 can be electrically connected by the grounding plate 5X integrally formed of a spring material.

In FIG. 5, the image carrier 1 is driven to rotate in a direction of arrow shown in FIGS. 1 and 2 by transmission of a rotational driving force of a drive unit (not shown) to the gear 3 meshed with a driving-force transmitting member, such as a gear train, connected to the drive unit; in accordance with the rotation of the image carrier 1, the grounding plate 5X also rotates in the direction of arrow together with the flange 2, and, in a state where the two folded portions 5Xc opposed to each other bend due to the elasticity of the spring material, the two contact portions 5Xd rotate while sliding/contacting on conductive lubricant (not shown) applied to the outer circumferential surface of the shaft 4, thereby ensuring the conduction between the conductive base member 1A of the image carrier 1 and the shaft 4. As the conductive lubricant, for example, conductive grease or the like is used.

As described above, the shaft 4 is fixed, and the image carrier 1 rotates, so the grounding plate 5X constantly rotates and slides with respect to the shaft 4. Because of sliding between metals like this, an abnormal sound may be generated, or conduction failure may be caused by oxidation of metal. As a measure to prevent these, there is a method to apply conductive lubricant (for example, conductive grease) to a site of contact between the grounding plate 5X and the shaft 4; however, this method has a problem that at a contact point between metal members, the conductive lubricant gets scraped off and removed with increased sliding time, and at a contact point between the grounding plate 5X and the shaft 4, the conductive lubricant is sometimes dried up; therefore, this method is very effective early in sliding, but does not reach a fundamental solution.

Reference Example

Figure 7:
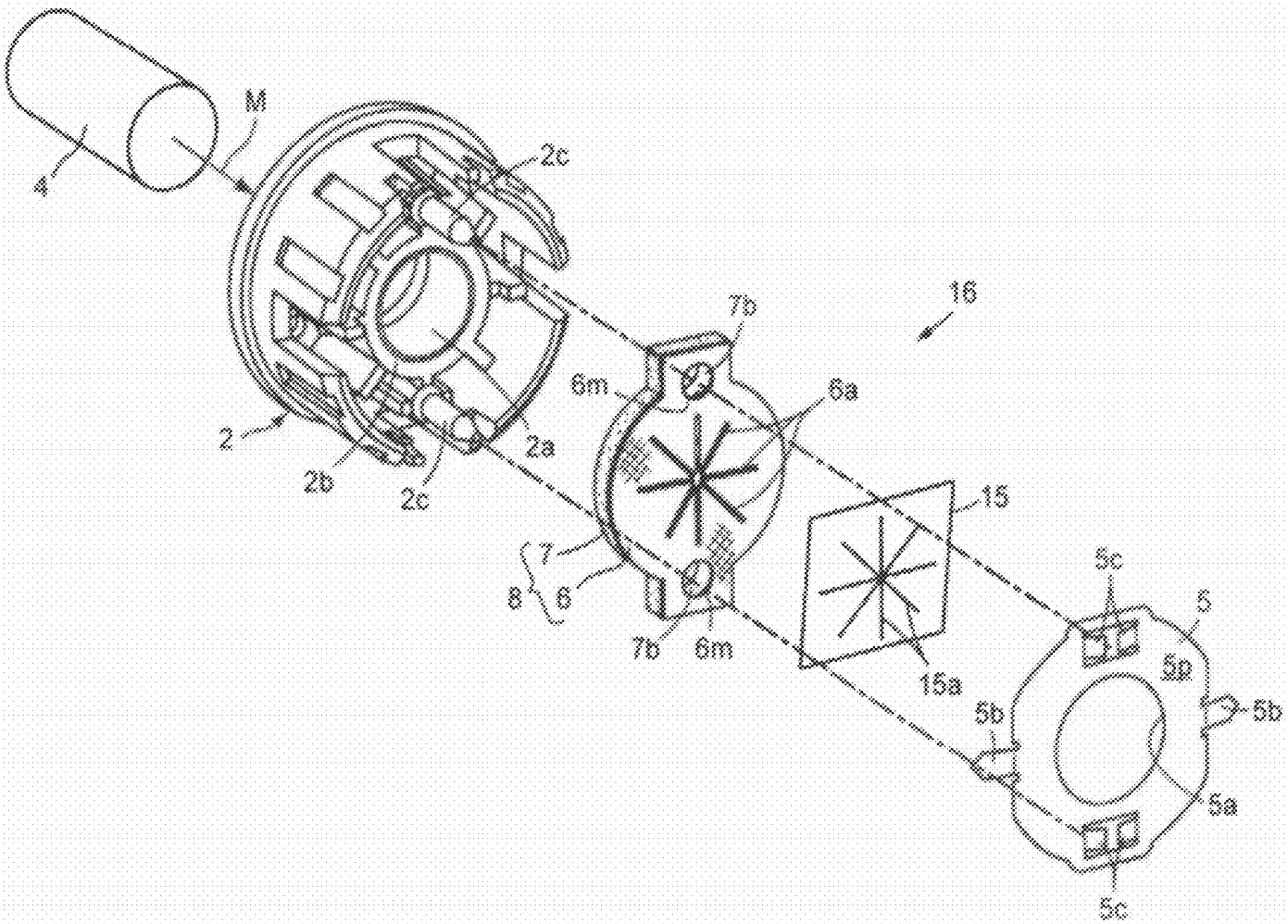
FIG. 7 is an exploded perspective view for explaining a configuration of a flange assy (or, assembly) and an insert state of a shaft in the reference example.
Figure 8:
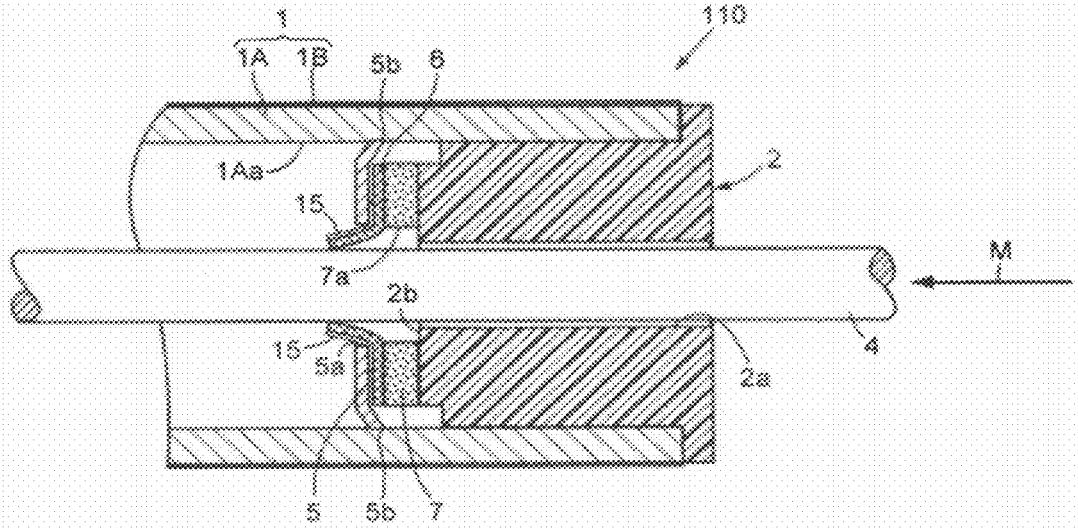
FIG. 8 is a cross-sectional view of one end portion of the image carrier unit along the longitudinal direction (the axial direction)
Figure 9A:
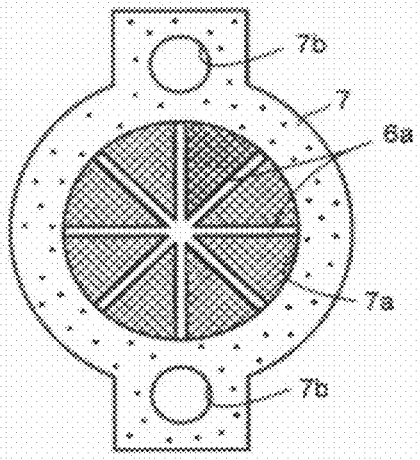
FIGS. 9A to 9C are a front view, a side view, and a rear view for explaining a configuration of a conductive-cloth assy, respectively.
Figure 9B:
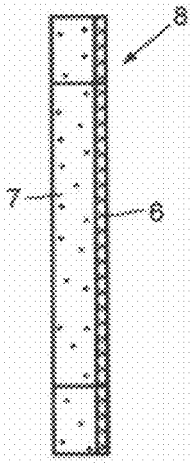
Figure 9C:
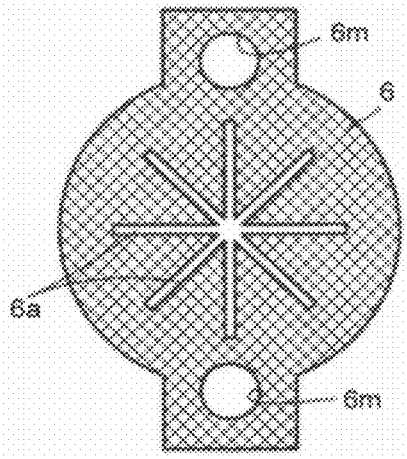
Figure 10A:
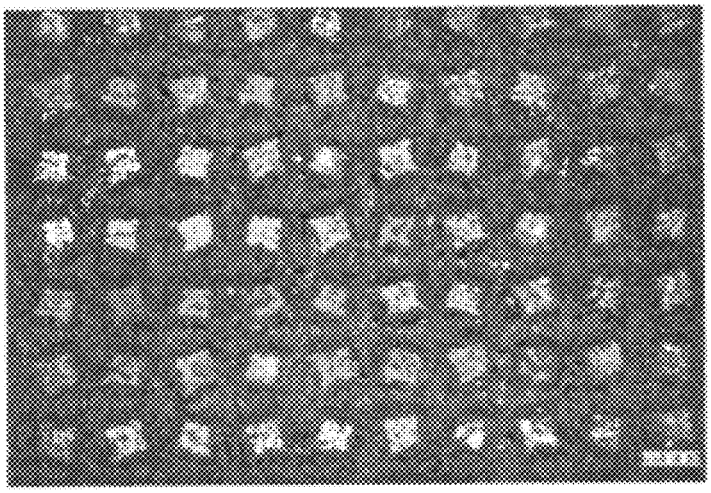
FIGS. 10A and 10B are micrographs of a magnified conductive cloth (magnified 30 times and 100 times, respectively)
Figure 10B:
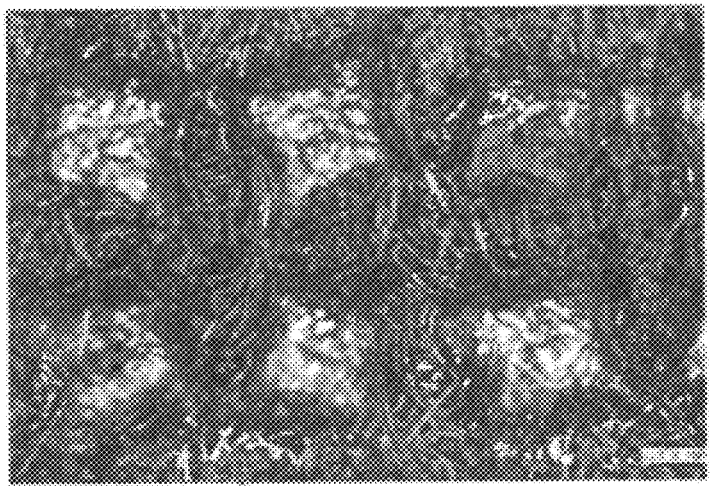
Figure 11:
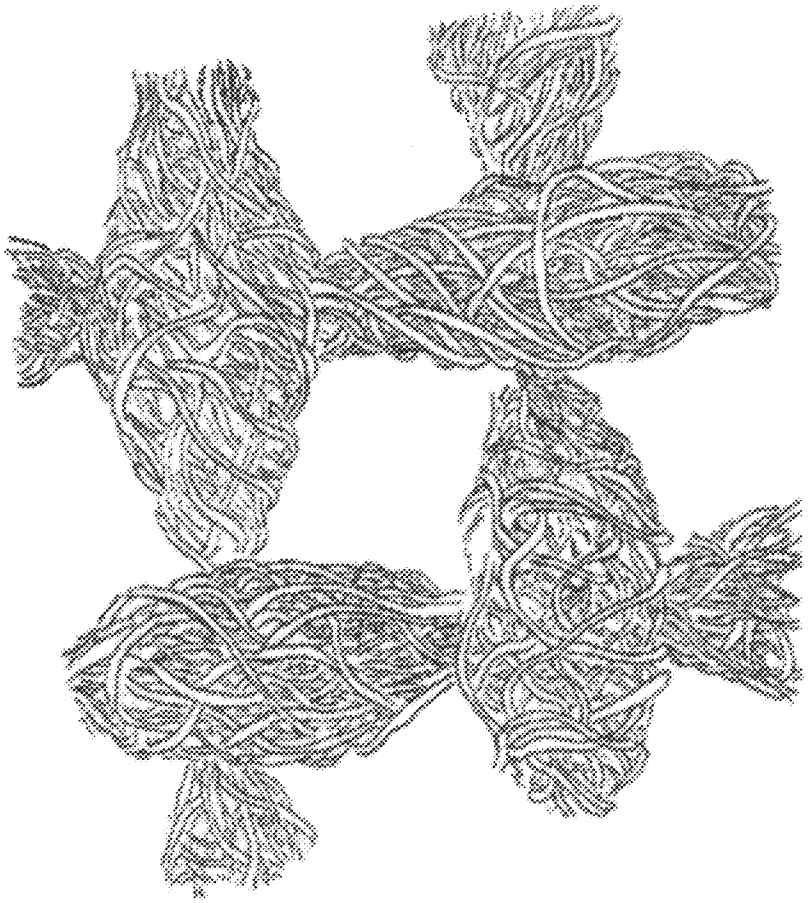
FIG. 11 is a schematic diagram of the conductive cloth (magnified 100 times)

The image carrier unit 110 according to a reference example in which a grounding configuration using a conductive cloth is employed is explained with reference to FIGS. 7 to 11. FIG. 7 is an exploded perspective view for explaining a configuration of a flange assy (or, assembly) and an insert state of a shaft in the reference example. FIG. 8 is a cross-sectional view of one end portion of the image carrier unit 110 along the longitudinal direction (the axial direction), and shows respective shapes and arrangement of the image carrier 1, the flange 2, the grounding plate 5X, a conductive cloth 6, a pressing member 7, and a polyethylene terephthalate (PET) sheet 15. FIG. 9 is a diagram for explaining a configuration of a conductive-cloth assy; FIGS. 9A, 9B, and 9C are a front view, a side view, and a rear view of the conductive-cloth assy, respectively. FIGS. 10A and 10B show micrographs of a magnified conductive cloth (magnified 30 times and 100 times, respectively). FIG. 11 is a schematic diagram of an actually-used conductive cloth (magnified 100 times).

In the above-described comparative example (according to a conventional technology) using a leaf spring, a sliding portion sliding on a shaft is brought into contact with the shaft by a metal spring material; in this reference example, there is described contact by a conductive cloth. The conductive cloth is a cloth made from conductive fiber, and details of the conductive cloth will be described later.

As shown in FIGS. 7 and 8, the image carrier unit 110 mainly includes the image carrier 1, the flange 2 as a flange member attached/fixed to one end of the image carrier 1, the gear 3 attached/fixed to the other end of the image carrier 1, and the shaft 4 as a contact member penetrating through the center of the flange 2 and the gear 3 thereby rotatably supporting the image carrier 1, which are the same components as the comparative example shown in FIG. 5, and further includes the conductive cloth 6 as a flexible cloth-like conductive member, a grounding plate 5 as a metallic conductive member and an electrifying (grounding) member, and the pressing member 7. The conductive cloth 6 has a slit 6*a* that enables the shaft 4 to insert/penetrate through the conductive cloth 6 and enables the conductive cloth 6 to bend and be in contact with the shaft 4 when the shaft 4 penetrates through the conductive cloth 6. A base end portion of the grounding plate 5 is in contact with the conductive cloth 6 and attached to the flange 2, and an end portion of the grounding plate 5 is fixed to the inner wall of the conductive base member 1A. The pressing member 7 presses the conductive cloth 6 against the grounding plate 5. Furthermore, as a means for ensuring conduction to the shaft 4, a flexible elastic body such as the PET sheet 15 is put on the conductive cloth 6 to increase contact pressure.

Figure 4:
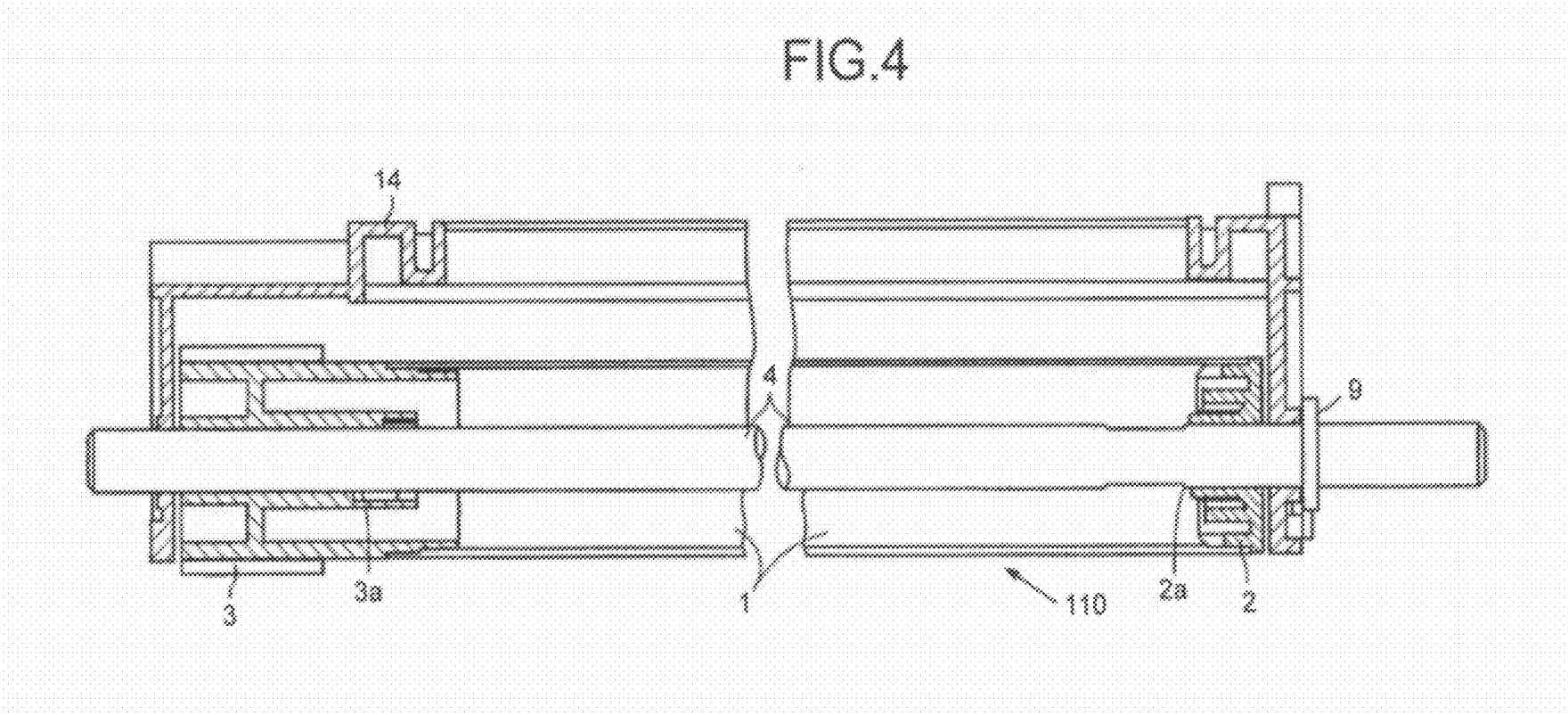
FIG. 4 is a cross-sectional view of both end portions of an image carrier unit according to a reference example along a longitudinal (axial) direction.

As shown in FIG. 4, around the image carrier unit 110, a frame 14 for supporting both ends of the shaft 4 of the image carrier unit 110 and a later-described conducting unit for electrically conducting, for example, grounding the shaft 4 are arranged.

As shown in FIGS. 4 and 8, the image carrier 1 is rotatably supported by the shaft 4 penetrating through a hole 2*a* formed on the center of the flange 2 and a hole 3*a* formed on the center of the gear 3. The shaft 4 is formed of metal, such as conductive special steel, or plated with a conductive film. The both ends of the shaft 4 are supported by the frame 14 of the process cartridge 58 shown in FIG. 2, and the shaft 4 is limited in rotation and also prevented from falling out to the left in FIG. 4 by an anti-rotation member 9, such as a snap ring. Furthermore, the shaft 4 is completely prevented from falling out to the axial direction by another member (not shown) attached to an end of the shaft 4 on the side opposite to the anti-rotation member 9. Incidentally, the both ends of the shaft 4 are chamfered (including round-chamfered); however, for simplicity of drawings, the chamfered edges are not illustrated except for FIG. 4.

When the process cartridge 58 shown in FIGS. 1 and 2 is placed within the main body frame 51 of the color image forming apparatus 50, in FIGS. 3 and 4, for example, an electrically-grounded stainless steel plate (not shown) attached to the main body frame 51 comes in contact with the end of the conductive shaft 4, and the shaft 4 is grounded. As described above, the electrically-grounded plate (not shown) attached to the main body frame 51 composes a conducting unit for electrically grounding the shaft 4.

As shown in FIGS. 2 and 8, the image carrier 1 has a configuration that the photosensitive layer 1B made of selenium or the like is formed on the surface of the conductive base member 1A formed of aluminum or the like. In FIG. 2, the image carrier 1 repeatedly performs operations, such as charging, development, and transfer of a toner image, on the photosensitive layer 1B by means of the charging roller 11 of the charging device, the developing roller 12 of the developing device, and the primary transfer roller 54 of the primary transfer device (not shown in FIG. 2, see FIG. 1) which are arranged around the image carrier 1, and eventually forms an image on a sheet S, such as a sheet of paper, by transferring the toner image transferred onto the image carrier 1 onto the sheet S via the intermediate transfer belt 53. In the present reference example, the conductive base member 1A of the image carrier 1 corresponds to an object to be electrified (grounded) (the same shall apply hereinafter).

In the image carrier 1, the charging operation is repeatedly performed, and the charging voltage is high; therefore, to ensure conduction between the image carrier 1 driven to rotate and the shaft 4 thereby easily releasing static electricity and also to reduce vibration thereby preventing generation of an abnormal sound and oxidation caused by sliding between metals, in the present reference example, the conductive cloth 6, the grounding plate 5 formed of a metal spring material, the pressing member 7, and the PET sheet 15 are formed and arranged as described above and below, thereby preventing occurrence of a defect in an image, generation of an abnormal sound, and oxidation of a metal member, etc.

As shown in FIGS. 4, 7, and 8, the flange 2 has the hole 2*a* into which the shaft 4 is inserted (penetrates) to be supported, the mounting surface 2*b* which is provided on the inner side of the flange 2 and is parallel to the plane perpendicular to the central axis of the shaft 4, i.e., the rotation axis of the image carrier 1, and two bosses (see the bosses 2*c* of the flange 2 shown in FIG. 7) formed on the mounting surface 2*b* in a projecting manner; these are integrally formed of electrical insulating resin which can be processed with thermal caulking. When the flange 2 is press-fitted into the inner wall 1Aa of the conductive base member 1A, the flange 2 is firmly fixed to the one end of the image carrier 1 by an appropriate fixing means. The appropriate fixing means includes to press-fit the flange 2 into the conductive base member 1A by a pair of pressure contact portions 5*b* of the grounding plate 5 to be described below. Incidentally, the detailed shape of the flange 2 is shown in FIGS. 7 and 8; however, for simplicity of drawings, the simplified flange 2 is shown in the drawings except FIGS. 7 and 8 as long as there is no hindrance to the explanation of the reference example.

As shown in FIG. 7, the grounding plate 5 is substantially square-shaped with four corners rounded, and has a through hole 5*a*, a plurality of pressure contact portions 5*b*, a plurality of boss fixing claws 5*c*, and a flat plate portion 5*p*, and is integrally formed of a spring material in the same manner as in the comparative example. The through hole 5*a* is provided to keep the grounding plate 5 from being in contact with the shaft 4. The flat plate portion 5*p* is provided as a mounted portion, and the base end of the flat plate portion 5*p* comes in contact with the conductive cloth 6 and is mounted on the mounting surface 2*b* of the flange 2 via the conductive cloth 6 and the pressing member 7 and fixed at least two points as will be described later. The plurality of (two, in the present reference example) pressure contact portions 5*b* is pressed against (substantially fixed to) the conductive base member 1A by an elastic force of a spring as if the pressure contact portions 5*b*, which extend from the flat plate portion 5*p* in the radial direction of the conductive base member 1A, were partly biting into the inner wall 1Aa of the conductive base member 1A. The boss fixing claws 5*c* are attached to a plurality of (two, in the present reference example) bosses (not shown, see the bosses 2*c* of the flange 2 shown in FIG. 5) formed on the flange 2 to be elastically engaged with the bosses. To keep the grounding plate 5 from being in contact with the shaft 4, the through hole 5*a* in the grounding plate 5 has a diameter larger than the outside diameter of the shaft 4.

The pressure contact portions 5*b* are formed in a pointed triangular shape so as to be pressed against and fixed to the conductive base member 1A as if the tips of the pressure contact portions 5*b* were biting into the inner wall 1Aa of the conductive base member 1A (see, for example, FIG. 8). The two boss fixing claws 5*c* act as the basis for positioning the grounding plate 5 in a two-dimensional direction. The grounding plate 5 is positioned in a three-dimensional direction with respect to the flange 2 by the boss fixing claws 5*c* and the flat plate portion 5*p*, and is placed in the image carrier 1.

Incidentally, after the bosses (see the bosses 2*c* of the flange 2 shown in FIG. 5) are elastically engaged with and fixed to the boss fixing claws 5*c*, the tips (heads) of the bosses 2*c* can be caulked by thermal welding so as to fix/hold the bosses securely.

There is described the conductive cloth. The conductive cloth is also called a static eliminating cloth, and is formed of a cloth-like material (conductive fiber) into which at least any one of polyethylene terephthalate fiber, nylon fiber, and polyester fiber, nickel, and copper are woven, and has a conductive property and a moderate lubricating property; therefore, even if the conductive cloth is in contact with a slid object, no abnormal sound is generated, and the slid object is not oxidized, and also the stable conduction can be ensured. Furthermore, when a metal is slid on another metal, application of conductive lubricant for reduction of sliding resistance can be eliminated; therefore, it is possible to reduce the burden on the environment.

FIGS. 10A and 10B show micrographs of a magnified conductive cloth which was actually used in the present reference example; FIG. 10A shows the micrograph of the conductive cloth magnified 30 times, and FIG. 10B shows the micrograph of the conductive cloth magnified 100 times. FIG. 11 shows a schematic diagram of the actually-used conductive cloth (magnified 100 times). As can be seen from FIGS. 10 and 11, the conductive cloth is composed of fiber bundles that conductive fibers are woven and formed into ropes, and the fiber bundles are braided in a reticular pattern. This conductive cloth has a resistance value of less than 0.01Ω and a thickness of 0.25 mm.

As shown in FIGS. 7 and 9, the conductive cloth 6 in the present reference example has the slit 6*a* through which the shaft 4 penetrates, and a portion of the conductive cloth 6 other than the slit 6*a* is in contact with the grounding plate 5. Incidentally, in the present reference example, the conductive cloth 6 is formed on the back side of the grounding plate 5 in FIGS. 7 and 8 so that the outer circumferential shape of the conductive cloth 6 is larger than the through hole 5*a*, and has an area that does not overlap the PET sheet 15; therefore, in an area overlapping the flat plate portion 5*p* of the grounding plate 5, the conductive cloth 6 is in contact with the grounding plate 5. This enables conduction between the grounding plate 5 and the conductive cloth 6.

In the conductive cloth 6 in the present reference example, a plurality of (eight, in the example shown in FIGS. 7 and 9) slits 6*a* is made radially so as to meet in the center of the conductive cloth 6. The end of each slit 6*a* extends close to a portion equivalent to the outside diameter of the shaft 4 so that the shaft 4 can easily penetrate through the conductive cloth 6.

To actively utilize the flexibility of the conductive cloth 6, various forms and modified examples of the slits 6*a*, such as only "slits" like in the present reference example that do not produce any chip and waste, a "cutout" (including a notch and a punched hole, etc.) that produces chips and waste, and combinations of slits and cutouts, have been invented; examples of these will be described later.

The pressing member 7 is formed of a nonmetallic elastic body containing at least any one of rubber and sponge; for example, urethane foam rubber is used.

An example of a flange assembly (a flange assy) and an example of a conductive-cloth assembly (a conductive-cloth assy) are explained with reference to FIGS. 7 and 9. FIG. 7 shows a configuration of an assembly 16 of the flange 2 and components to be described below (hereinafter, referred to as the "flange assy 16") to be built into the photoreceptor composing the image carrier unit. The flange assy 16 is composed of the flange 2, an assembly 8 of the conductive cloth 6 and the pressing member 7 (hereinafter, referred to as the "conductive-cloth assy 8"), the PET sheet 15, and the grounding plate 5.

As shown in FIGS. 7 and 9, the conductive-cloth assy 8 is that the conductive cloth 6 and the pressing member 7 are taped together via double-sided tape (not shown); specifically, the pressing member 7 is taped to the surface of the conductive cloth 6 on the side of the mounting surface 2*b* of the flange 2, i.e., on the side opposite to the grounding plate 5 with double-sided tape. Even if the pressing member 7 and the conductive cloth 6 are not taped together and are provided as separate parts, they perform the same function; therefore, the pressing member 7 and the conductive cloth 6 do not necessarily have to be integrated. Here, for ease of explanation, the pressing member 7 and the conductive cloth 6 shall be taped together with double-sided tape.

A method of processing the conductive cloth 6 and the pressing member 7 into the conductive-cloth assy 8 is briefly explained. First, double-sided tape is attached to an unprocessed pressing member 7 having a predetermined thickness. Then, two through holes 7*a* larger than the shaft outside diameter are made in the center of the pressing member 7 so as to enable the shaft 4 to penetrate therethrough.

Then, an unprocessed conductive cloth 6 in which slits 6*a* have not yet been made is taped to the pressing member 7 with the through hole 7*a* by the double-sided tape attached to the pressing member 7. At last, a taped-together set of the conductive cloth 6 and the pressing member 7 is cut out. For example, using a press forming die, the taped-together set is cut out from the side of the conductive cloth 6, and a shaping process of the conductive cloth 6, i.e., a process of making eight radially-arranged slits 6*a* and two boss holes 6*m* in the conductive cloth 6 and a shaping process of the pressing member 7, i.e., a process of making a through hole 7*a* and two boss holes 7*b* in the pressing member 7 are simultaneously performed. Through the above processes, the conductive-cloth assy 8 shown in FIGS. 7 and 9 can be obtained.

In FIGS. 7 and 9, etc., for simplicity's sake, gaps of the slits 6*a* of the conductive cloth 6 are exaggerated and expanded; actually, the gaps of the slits 6*a* are not apparent (the same shall apply hereinafter).

The pressing member 7 is used to reliably bring the conductive cloth 6 into contact with the grounding plate 5 in order to ensure the electric conduction. Meanwhile, the conductive cloth 6 and the pressing member 7 are taped together with double-sided tape for enhancing the assembly performance of the photoreceptor. In short, it is only necessary to electrically connect the conductive cloth 6 to the grounding plate 5, so the double-sided tape for taping the conductive cloth 6 and the pressing member 7 together does not have to have a conductive property.

Here, a concern for only the conductive cloth is supplemented. In a case where a slit is made in the conductive cloth to bring the conductive cloth into contact with the shaft with the slit flexed/bent, contact pressure applied to the shaft is only a pressing force caused by bending of the conductive cloth. A pressing force due to the flexibility and elastic restoring force of the conductive cloth is small, and if left at high temperature, the conductive cloth may not be restored to an original position. If the conductive cloth reaches this state, the contact with the shaft becomes unstable, and this may result in failure of conduction. Therefore, in the present reference example, to make the conduction stable, as a means to increase contact pressure applied to the shaft, the PET sheet 15 is provided as follows.

As shown in FIG. 7, the above-described conductive-cloth assy 8 is attached to the inside of the flange 2, and the PET sheet 15 as an elastic body is attached to the conductive-cloth assy 8 attached to the flange 2. Then, the grounding plate 5 is put onto the PET sheet 15 and pushed into the flange 2, and fixed to the inside of the flange 2 with the conductive cloth 6 and the pressing member 7 sandwiched in between. Tests using a 0.075 mm-thick PET sheet 15 and a 0.125 mm-thick PET sheet 15 confirmed that these PET sheets 15 fulfill at least a sufficient function.

In the present reference example, a transparent PET sheet is used as the PET sheet 15, and the PET sheet 15 is near-square rectangular in outer circumferential shape and has the outer circumference smaller than those of the conductive cloth 6 and the grounding plate 5 (especially, a part near the boss holes 6*m* and a part near the boss fixing claws 5*c*). Namely, the shape of the outer circumference of the PET sheet 15 is formed not to extend to the periphery of the boss holes 6*m* on the conductive cloth 6 and the periphery of the boss fixing claws 5*c* of the grounding plate 5. Therefore, in attachment and fixation of the grounding plate 5 into the flange 2, when the boss fixing claws 5*c* of the grounding plate 5 are engaged with the bosses 2*c* of the flange 2, the conductive cloth 6 can be in contact with the grounding plate 5 at portions closest to the fixed points of the boss fixing claws 5*c* of the grounding plate 5; therefore, the conductive cloth 6 is firmly in close contact with the grounding plate 5, and the conduction is stable. In the same manner as the conductive cloth 6, in the PET sheet 15, a plurality of (eight, in the example shown in FIG. 7) slits 15*a* is made radially so as to meet in the center of the PET sheet 15.

Incidentally, the PET sheet 15 just has to exist between the conductive cloth 6 and the grounding plate 5 so as to enable the shaft 4 to penetrate therethrough, and does not have to be fixed to the conductive cloth 6 and the grounding plate 5. However, to adjust the phase of the PET sheet 15 so as not to misalign the slits 15*a* of the PET sheet 15 and the slits 6*a* of the conductive cloth 6 and to simplify the die machining and processing steps, the step of producing the PET sheet 15 can be incorporated in the step of processing the conductive-cloth assy 8 described above or an appropriate positioning means, such as embossing, can be provided.

An example of a method of assembling the flange assy 16 is explained with reference to FIG. 7. First, the surface of the pressing member 7 in the conductive-cloth assy 8 is set to face to the side of the mounting surface 2*b* of the flange 2, and the bosses 2*c* of the flange 2 are fitted into the boss holes 7*b* and 6*m* of the conductive-cloth assy 8. Then, in a state where the PET sheet 15 is sandwiched between the conductive-cloth assy 8 and the grounding plate 5, the boss fixing claws 5*c* of the grounding plate 5 are engaged with the bosses 2*c* of the flange 2 protruding from the boss holes 7*b* and 6*m* of the conductive-cloth assy 8, thereby the boss fixing claws 5*c* of the grounding plate 5 are elastically engaged with, i.e., fixed to the bosses 2*c* of the flange 2 by the spring action of the boss fixing claws 5*c*, and the grounding plate 5 is fixedly held by the flange 2.

As described above, the pressing member 7, the conductive cloth 6, the PET sheet 15, and the grounding plate 5 are placed within the flange 2 in this order from inside, and the grounding plate 5 is fixed to the inside of the flange 2 with the pressing member 7, the conductive cloth 6, and the PET sheet 15 sandwiched in between.

An example of a method of assembling the image carrier unit 110 is explained with reference to FIGS. 3, 7, and 8. By the above-described method of assembling the flange assy 16, the grounding plate 5 is fixedly held by the flange 2, and at this time, the fixed points between the boss fixing claws 5*c* of the grounding plate 5 and the bosses 2*c* of the flange 2 and the pressure contact portions 5*b* of the grounding plate 5 are positioned so as to make a phase angle of about 90 degrees. After that, the assembly of the flange 2 (the flange assy) to which the grounding plate 5 is fixed with the pressing member 7 and the conductive cloth 6 (the conductive-cloth assy 8) and the PET sheet 15 sandwiched in between is press-fitted into the inner wall 1Aa of the conductive base member 1A with a flange press jig (not shown) or the like to fix the flange assy to one end of the image carrier 1. At this time, since the diameter between the outer ends of the pressure contact portions 5*b* (the circumscribed circle diameter) of the grounding plate 5 is moderately larger than the diameter of the inner wall 1Aa (the inside diameter) of the conductive base member 1A, the grounding plate 5 is press-fitted into the inner wall 1Aa of the conductive base member 1A with the tips of the pressure contact portion 5*b* elastically deformed as if the tips of the pressure contact portion 5*b* were biting into the inner wall 1Aa, thereby the flange assy is firmly fixed to the inside of the image carrier 1.

Then, when the shaft 4 is inserted into the assembly of the flange 2 (the flange assy 16), which has been fixed to the inside of the image carrier 1, in a contact direction M from outside the flange 2, the shaft 4 penetrates through the hole 2*a* of the flange 2 as shown in FIG. 8, and after that, the tip of the shaft 4 is pressed against the conductive cloth 6, and the slits 6*a* are opened, and also the slits 15*a* of the PET sheet 15 are opened. When the shaft 4 is further inserted in the contact direction M, the shaft 4 penetrates through the slits 6*a* made in the conductive cloth 6 and the slits 15*a* of the PET sheet 15 while pushing the slits 6*a* and the slits 15*a* apart, and at this time, in a state where a pressing force due to bending/flexing of the PET sheet 15 acts on a bent/flexed portion of the slits 6*a* in the conductive cloth 6 and a meeting point of the slits 6*a* in the conductive cloth 6 bends in the same direction as the contact direction M (hereinafter, also referred to as the "insertion direction M") of the shaft 4, a plurality of areas of the conductive cloth 6 is in contact with the shaft 4.

As described above, the grounding plate 5 is fixed to the flange 2 with the PET sheet 15, the conductive cloth 6, and the pressing member 7 sandwiched in between, and then the flange 2 is press-fitted into the inside of the image carrier 1, thereby the conductive base member 1A and the grounding plate 5, the grounding plate 5 and the conductive cloth 6, and the conductive cloth 6 and the shaft 4 come in contact, respectively, thereby eventually achieving conduction between the conductive base member 1A and the shaft 4. On this occasion, as a method for contact between the grounding plate 5 and the conductive cloth 6, the pressing member 7 is arranged between the flange 2 and the conductive cloth 6, and the PET sheet 15 is sandwiched between the conductive cloth 6 and the grounding plate 5, and then the PET sheet 15, the conductive cloth 6, and the pressing member 7 are pushed by the grounding plate 5, so that the pressing member 7 is elastically compressed and deformed, thereby the conductive cloth 6 can be stably in contact with the grounding plate 5. This stably ensures the conduction over time.

As described above, the pressure contact portions 5*b* of the grounding plate 5 are fixed to the inner wall 1Aa of the conductive base member 1A, thereby achieving conduction to the conductive base member 1A, so the flat plate portion 5*p* (a base end portion) of the grounding plate 5 corresponds to the side of an object to be electrified (grounded). Therefore, in the present reference example, it is configured that a portion of the conductive cloth 6 is brought into contact with the flat plate portion 5*p* of the grounding plate 5 on the side of an object to be electrified (grounded), and the rest of the conductive cloth 6 is bent and comes in contact with the shaft 4.

In FIGS. 3 and 4, a rotational driving force of a drive unit (not shown) is transmitted to the gear 3 meshed with a driving-force transmitting member, such as a gear train, connected to the drive unit, thereby the image carrier 1 is driven to rotate in the direction of arrow shown in FIGS. 1 and 2, and the grounding plate 5 also rotates in the direction of arrow shown in FIGS. 1 and 2 together with the flange 2, the conductive cloth 6, the PET sheet 15, and the pressing member 7, and the conductive cloth 6 rotates while being in sliding contact with the outer circumferential surface of the shaft 4 with a bent portion of the conductive cloth 6 subjected to a pressing force from the PET sheet 15. At this time, as the conductive cloth 6 has the conductive property and the moderate lubricating property, even though the conductive cloth 6 is in contact with the shaft 4 which is a slid object, the stable conduction can be ensured over time without generation of an abnormal sound and oxidation of the slid object. Furthermore, application of conductive lubricant (for example, conductive grease used in the comparative example) for reduction of resistance of sliding between metals can be eliminated; therefore, it is possible to achieve and provide the environmentally-friendly image carrier unit 110, process cartridge 58, and color image forming apparatus 50 shown in FIG. 1 which are capable of reducing the burden on the environment.

As for contact between the conductive cloth 6 and the shaft 4, the conductive cloth 6 can achieve moderate contact pressure in the contact with the shaft 4 with the contact pressure increased by bending of the conductive cloth 6 and a pressing force from the PET sheet 15, and this performance can be achieved by a very simple process of just making the slits 6*a* in the conductive cloth 6. The conductive cloth 6 contains metal, but it is not a main material; therefore, an abnormal sound and conduction failure due to oxidation, which are problems in the conventional technologies, do not occur.

Furthermore, by the above-described configuration and especially a state of contact between a portion of the conductive cloth 6 around the slits 6*a* and the shaft 4 shown in FIG. 7, the portion of the conductive cloth 6 around the slits 6*a* in contact with the shaft 4 can have moderate stiffness, and is less likely to bend in a direction opposite to the insertion direction M of the shaft 4; moreover, as the width of the contact portion with the shaft 4 becomes smaller toward the shaft center, the contact pressure becomes lower, so a low-load electrification, such as grounding, configuration can be achieved. In this manner, the contact portion tapers toward the tip, so the tip portion is flexibly in contact with the shaft 4 but is pliant and hard to break.

However, it is found that the reference example shown in FIGS. 7 to 9 and the like requires further improvements. Namely, in the reference example, the PET sheet 15 is added to increase the contact pressure of the conductive cloth 6 to be applied to the shaft 4; therefore, the number of components and the cost are increased. Furthermore, in the reference example, the electrical insulating pressing member made of a nonconductive material and the like cannot be placed on a portion of the conductive cloth 6 in contact with the shaft 4 and a portion of the conductive cloth 6 in contact with the grounding plate 5; therefore, in a configuration as shown in FIG. 8 in which the shaft 4 is inserted from outside the flange 2, the side of the bent conductive cloth 6 in contact with the shaft 4 and the side of the conductive cloth 6 in contact with the grounding plate 5 cannot be the same side. Therefore, the pressing member 7 attached to the conductive cloth 6 is located on the side of the conductive cloth 6 in contact with the oncoming shaft 4, and the pressing member 7 has to be formed into a shape that an area corresponding to the portion of the conductive cloth 6 in contact with the shaft 4 and its surrounding area is removed (the through hole 7*a*). Namely, the pressing member 7 taped to one side of the conductive cloth 6 is formed to have the through hole 7*a* made by removing the center portion of the pressing member 7. A processing step of cutting out the center portion of the pressing member 7 is added, and this further increases the cost.

To solve the problems in the reference example shown in FIGS. 7 to 9, etc., we have developed the invention according to the following embodiments.

First Embodiment

Figure 12:
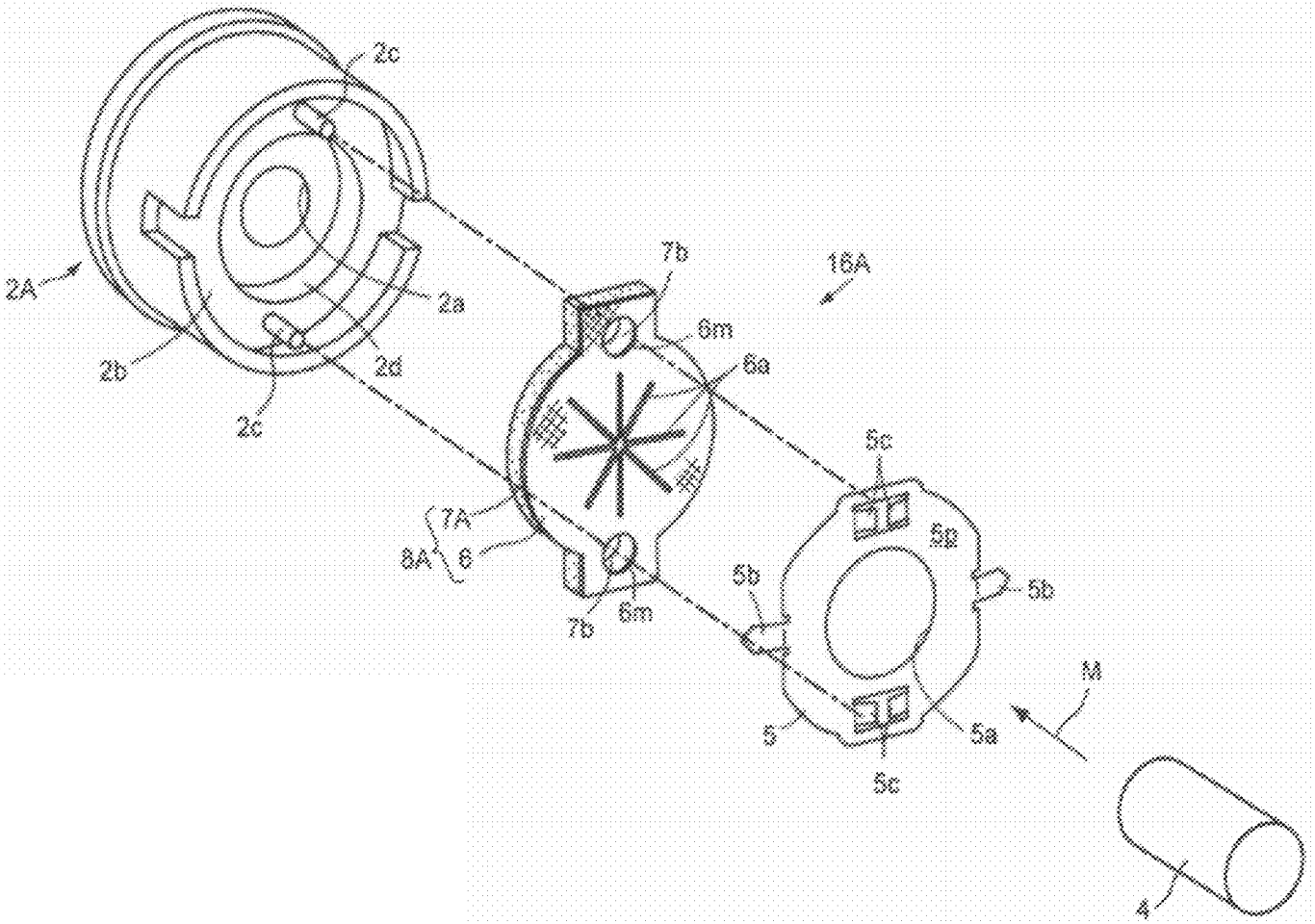
FIG. 12 is an exploded perspective view for explaining a configuration of a flange assy and an insert state of the shaft in a first embodiment.
Figure 13A:
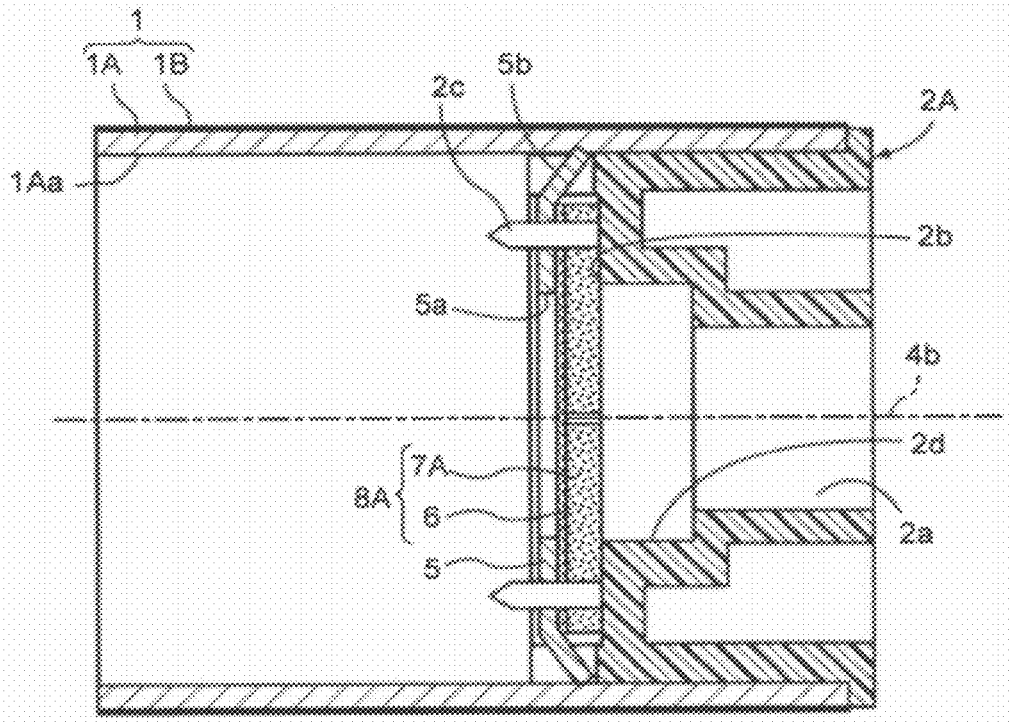
FIGS. 13A and 13B are cross-sectional views of one end portion of an image carrier unit in the first embodiment along the longitudinal direction (the axial direction), and show respective shapes and arrangement of components before and after insertion of the shaft, respectively.
Figure 13B:
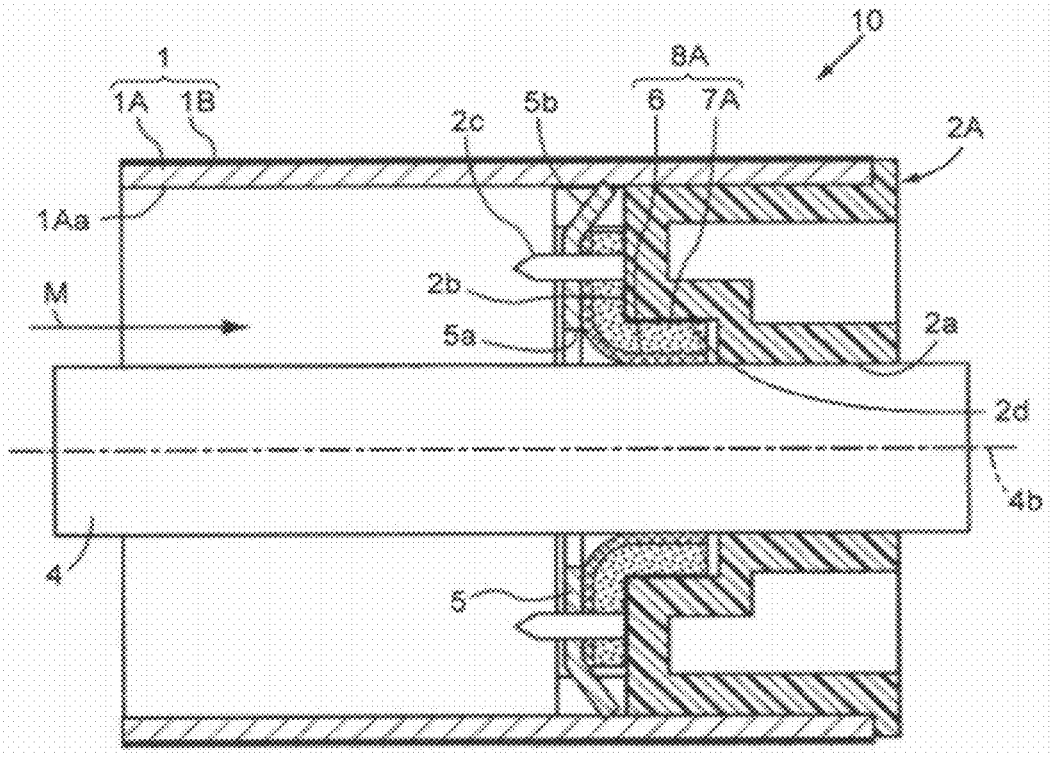
Figure 14A:
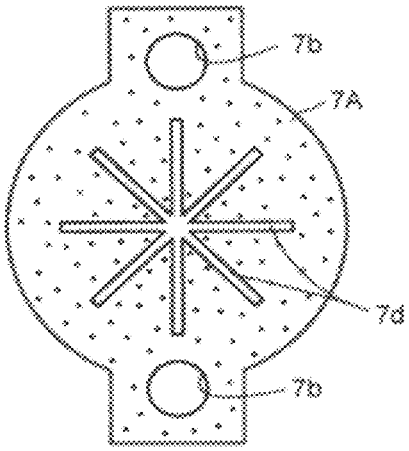
FIGS. 14A to 14C are a front view, a side view, and a rear view for explaining a configuration of a conductive-cloth assy respectively in the first embodiment.
Figure 14B:
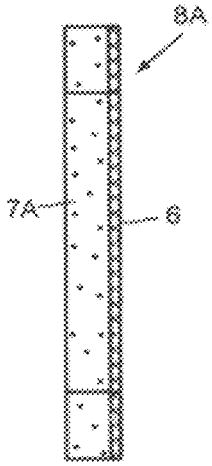
Figure 14C:
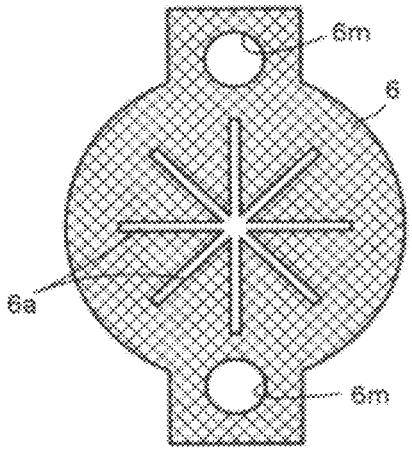

The image carrier unit 10 composing the process cartridge 58 according to a first embodiment and components of the image carrier unit 10 are explained with reference to FIGS. 12 to 14. FIG. 12 is an exploded perspective view for explaining a configuration of a flange assy and an insert state of the shaft in the first embodiment. FIG. 13 is a cross-sectional view of one end portion of the image carrier unit 10 along the longitudinal direction (the axial direction); FIGS. 13A and 13B shows respective shapes and arrangement of the image carrier 1, a flange 2A, the grounding plate 5, the conductive cloth 6, and a pressing member 7A before and after insertion of the shaft 4, respectively. FIG. 14 is a diagram for explaining a configuration of a conductive-cloth assy 8A; FIGS. 14A, 14B, and 14C are a front view, a side view, and a rear view of the conductive-cloth assy 8A, respectively.

The first embodiment differs from the reference example shown in FIGS. 7 to 11 mainly in that the differently-shaped flange 2A is used instead of the flange 2; the pressing member 7A on which no through hole 7*a* is formed is used instead of the pressing member 7; the PET sheet 15 is removed; and the insertion direction M of the shaft 4 is changed to a direction from the side of the grounding plate 5 which is the side of the other end of the image carrier unit 10. Except these differences, the image carrier unit 10 according to the first embodiment has the same configuration as the image carrier unit 110 according to the reference example shown in FIGS. 7 to 11.

The image carrier unit 10 according to the first embodiment is explained in detail below with a focus on the above-mentioned differences.

As shown in FIGS. 12 and 13, the flange 2A differs from the flange 2 in the reference example mainly in that the flange 2A has a holding portion 2*d* as a first contact holding portion between the mounting surface 2*b* on which the conductive cloth 6 and the pressing member 7A (the conductive-cloth assy 8A to be described below) are mounted and the hole 2*a* of the flange 2A. The holding portion 2*d* has an inner wall surface that comes in contact with a bent/flexed portion of the conductive cloth 6 and a compressed portion of the pressing member 7A in the conductive-cloth assy 8A when the center part of slits made in the conductive-cloth assy 8A to be described below bends/flexes to the side of the hole 2*a* of the flange 2A, and houses and holds these portions therein. Except this difference, the flange 2A has the same configuration as the flange 2 in the reference example. The holding portion 2*d* is connected to the hole 2*a*, and the inner wall surface of the holding portion 2*d* is cut off to form a ring-like space extending in the radial direction so as to form a space larger than the size of the hole 2*a* in the radial direction. Hereinafter, holding portions, including the holding portion 2*d*, in cross-sectional views are depicted as an inner wall surface.

Namely, the flange 2A has the hole 2*a* into which the shaft 4 is inserted to be supported, the mounting surface 2*b* which is provided on the inner side of the flange 2A and is parallel to the plane perpendicular to a center line 4*b* of the shaft 4, i.e., the rotation axis of the image carrier 1, the two bosses 2*c* formed on the mounting surface 2*b* in a projecting manner, and the holding portion 2*d* having the inner wall surface; these are integrally formed of electrical insulating resin which can be processed with thermal caulking.

In the present embodiment, the pressing member 7A also serves as an elastically-deformable insulating pushing member for pushing the conductive cloth 6 against the shaft 4. As shown in FIGS. 12 and 14, the pressing member 7A doubling as the pushing member differs from the pressing member 7 in the reference example in that no through hole 7*a* is formed on the pressing member 7A, and a plurality of (eight, in the example shown in FIG. 14) slits 7*d* is made radially so as to meet in the center of the pressing member 7A in the same manner as the conductive cloth 6. Except these differences, the pressing member 7A is identical to the pressing member 7 in the reference example.

Namely, the pressing member 7A has the two boss holes 7*b* and the plurality of radially-arranged slits 7*d*, and is formed of a nonmetallic elastic body containing at least any one of rubber and sponge; for example, urethane foam rubber is used as a material of the pressing member 7A.

An example of a conductive-cloth assembly (a conductive-cloth assy) is explained with reference to FIGS. 12 and 14. FIG. 12 shows a configuration of an assembly 16A of the flange 2A and components to be described below (hereinafter, referred to as the "flange assy 16A") to be built into the photoreceptor composing the image carrier unit. The flange assy 16A is composed of the flange 2A, an assembly 8A of the conductive cloth 6 and the pressing member 7A (hereinafter, referred to as the "conductive-cloth assy 8A"), and the grounding plate 5.

As shown in FIGS. 12 and 14, the conductive-cloth assy 8A is that the conductive cloth 6 and the pressing member 7A are taped together via double-sided tape (not shown); specifically, the pressing member 7A is taped to the surface of the conductive cloth 6 on the side of the mounting surface 2*b* of the flange 2A, i.e., on the side opposite to the grounding plate 5 with double-sided tape. Even if the pressing member 7A and the conductive cloth 6 are not taped together and are provided as separate parts, they perform the same function; therefore, the pressing member 7A and the conductive cloth 6 do not necessarily have to be integrated. Here, for ease of explanation, the pressing member 7A and the conductive cloth 6 shall be taped together with double-sided tape.

A method of processing the conductive cloth 6 and the pressing member 7A into the conductive-cloth assy 8A is about the same as the conductive-cloth assy 8 in the reference example. Namely, first, double-sided tape is attached to an unprocessed pressing member 7 having a predetermined thickness. Then, an unprocessed conductive cloth 6 in which slits 6*a* have not yet been made is taped to the unprocessed pressing member 7A by the double-sided tape attached to the pressing member 7A. At last, a taped-together set of the conductive cloth 6 and the pressing member 7A is cut out. For example, using a press forming die, the taped-together set is cut out from the side of the conductive cloth 6, and a shaping process of the conductive cloth 6, i.e., a process of making eight radially-arranged slits 6*a* and two boss holes 6*m* in the conductive cloth 6 and a shaping process of the pressing member 7A, i.e., a process of making two boss holes 7*b* in the pressing member 7A are simultaneously performed. Through the above processes, the conductive-cloth assy 8A shown in FIGS. 12 and 14 can be obtained.

The shape of the slits to be made in the conductive-cloth assy 8A and the conductive cloth 6 is not limited to a radial fashion shown in the drawings and is not particularly specified, and can be any other fashions as long as the conductive-cloth assy 8A and the conductive cloth 6 can bend/flex when the shaft 4 is inserted therethrough. Namely, the conductive cloth as a conductive member just has to have at least any one of slits and a cutout to enable the shaft to penetrate therethrough and enable the conductive cloth to bend and be in contact with the shaft when the shaft penetrates through the conductive cloth. Modified examples of the shape of slits and a cutout, etc. made in the conductive cloth will be described later.

The pressing member 7A is used to reliably bring the conductive cloth 6 into contact with the grounding plate 5 in order to ensure the electric conduction. Meanwhile, the conductive cloth 6 and the pressing member 7A are taped together with double-sided tape for enhancing the assembly performance of the photoreceptor. In short, it is only necessary to electrically connect the conductive cloth 6 to the grounding plate 5, so the double-sided tape for taping the conductive cloth 6 and the pressing member 7A together does not have to have a conductive property as is the case in the reference example.

An example of a method of assembling the flange assy 16A is explained with reference to FIG. 12. First, the surface of the pressing member 7A in the conductive-cloth assy 8A is set to face to the side of the mounting surface 2*b* of the flange 2A, and the bosses 2*c* of the flange 2A are fitted into the boss holes 7*b* and 6*m* of the conductive-cloth assy 8A. Then, in a state where the conductive-cloth assy 8A is sandwiched between the flange 2A and the grounding plate 5, the boss fixing claws 5*c* of the grounding plate 5 are engaged with the bosses 2*c* of the flange 2A protruding from the boss holes 7*b* and 6*m* of the conductive-cloth assy 8A, thereby the boss fixing claws 5*c* of the grounding plate 5 are elastically engaged with, i.e., fixed to the bosses 2*c* of the flange 2A by the spring action of the boss fixing claws 5*c*, and the grounding plate 5 is fixedly held by the flange 2A.

As described above, the pressing member 7A, the conductive cloth 6, and the grounding plate 5 are placed within the flange 2A in this order from inside, and the grounding plate 5 is fixed to the inside of the flange 2 with the pressing member 7A and the conductive cloth 6 sandwiched in between.

An example of a method of assembling the image carrier unit 10 is explained with reference to FIGS. 3, 12, and 13. By the above-described method of assembling the flange assy 16A, the grounding plate 5 is fixedly held by the flange 2A, and at this time, the fixed points between the boss fixing claws 5*c* of the grounding plate 5 and the bosses 2*c* of the flange 2A and the pressure contact portions 5*b* of the grounding plate 5 are positioned so as to make a phase angle of about 90 degrees. After that, the assembly 16A of the flange 2A (the flange assy 16A) to which the grounding plate 5 is fixed with the pressing member 7A and the conductive cloth 6 (the conductive-cloth assy 8A) sandwiched in between is press-fitted into the inner wall lAa of the conductive base member 1A with a flange press jig (not shown) or the like to fix the flange assy 16A to one end of the image carrier 1. At this time, since the diameter between the outer ends of the pressure contact portions 5*b* (the circumscribed circle diameter) of the grounding plate 5 is moderately larger than the diameter of the inner wall 1Aa (the inside diameter) of the conductive base member 1A, the grounding plate 5 is press-fitted into the inner wall 1Aa of the conductive base member 1A with the tips of the pressure contact portion 5*b* elastically deformed as if the tips of the pressure contact portion 5*b* were biting into the inner wall 1Aa, thereby the flange assy 16A is firmly fixed to the inside of the image carrier 1 (see FIG. 13A).

Then, as shown in FIG. 13A, when the shaft 4 is inserted into the assembly of the flange 2A (the flange assy 16A), which has been fixed to the inside of the image carrier 1, in the insertion direction M from inside the flange 2A, i.e., from the side of the gear 3 on the other end of the image carrier 1 as shown in FIGS. 12 and 13B, the shaft 4 penetrates through the through hole 5*a* of the grounding plate 5 as shown in FIG. 13B, and after that, the tip of the shaft 4 is pressed against the conductive cloth 6, and the slits 6*a* made in the conductive cloth 6 are opened, and also the slits 7*d* made in the pressing member 7A are opened. When the shaft 4 is further inserted in the insertion direction M, the shaft 4 penetrates through the slits 6*a* of the conductive cloth 6 and the slits 7*d* of the pressing member 7A while pushing the slits 6*a* and 7*d* apart, and at this time, in a state where a meeting point of the slits 6*a* in the conductive cloth 6 bends in the same direction as the insertion direction M of the shaft 4, a plurality of areas of the conductive cloth 6 is in contact with the shaft 4.

At this time, as shown in FIG. 13B, the slits 7*d* of the pressing member 7A in the conductive-cloth assy 8A bends/flexes to the side of the hole 2*a* made in the inside of the flange 2A together with the conductive cloth 6, and the pressing member 7A comes in contact with the holding portion 2*d* in the flange 2A and is held by the holding portion 2*d*. A space between a contact portion of the holding portion 2*d* in contact with the pressing member 7A (i.e., the inner wall surface of the holding portion 2*d*) and the shaft 4 is set to keep a distance at which the pressing member 7A is slightly compressed; therefore, the conductive cloth 6 is brought into contact with the shaft 4 while applying moderate contact pressure to the shaft 4 by the pressing member 7A. In this manner, the pressing member 7A plays a role to reliably bring the conductive cloth 6 into contact with the grounding plate 5 and also plays a role to bring the conductive cloth 6 into contact with the shaft 4 by means of compression at a contact point between the slits 6*a* of the conductive cloth 6 and the shaft 4, i.e., to press the conductive cloth 6 against the shaft 4 by the action of a compression force associated with compressive deformation of the elastically-deformable pressing member 7A on the conductive cloth 6.

As described above, the grounding plate 5 is fixed to the flange 2A with the conductive cloth 6 and the pressing member 7A sandwiched in between, and then the flange 2A is press-fitted into the image carrier 1, and this brings the conductive base member 1A and the grounding plate 5, the grounding plate 5 and the conductive cloth 6, and the conductive cloth 6 and the shaft 4 into contact with each other, respectively, thereby eventually achieving conduction between the conductive base member 1A and the shaft 4. On this occasion, as a method for contact between the grounding plate 5 and the conductive cloth 6, the pressing member 7A is arranged between the flange 2A and the conductive cloth 6, and the conductive cloth 6 and the pressing member 7A are pushed by the grounding plate 5, so that the pressing member 7A is elastically compressed and deformed, thereby the conductive cloth 6 can be stably in contact with the grounding plate 5. Therefore, according to the present embodiment, the conduction can be stably ensured over time.

In the same manner as in the reference example, in FIGS. 3 and 4, a rotational driving force of a drive unit (not shown) is transmitted to the gear 3 meshed with a driving-force transmitting member, such as a gear train, connected to the drive unit, thereby the image carrier 1 is driven to rotate in the direction of arrow shown in FIGS. 1 and 2, and the grounding plate 5 also rotates in the direction of arrow shown in FIGS. 1 and 2 together with the flange 2A, the conductive cloth 6, and the pressing member 7A, and the conductive cloth 6 rotates while being in sliding contact with the outer circumferential surface of the shaft 4 with a bent portion of the conductive cloth 6 subjected to a moderately low pressing force (contact pressure) from the pressing member 7A. At this time, as the conductive cloth 6 has the conductive property and the moderate lubricating property, even if the conductive cloth 6 is in contact with the shaft 4 which is a slid object, the stable conduction can be ensured over time without generation of an abnormal sound and oxidation of the slid object. Furthermore, application of conductive lubricant (such as conductive grease described above) for reduction of resistance of sliding between metals can be eliminated; therefore, it is possible to achieve and provide the environmentally-friendly image carrier unit 110, process cartridge 58, and color image forming apparatus 50 shown in FIG. 1 which are capable of reducing the burden on the environment.

As for contact between the conductive cloth 6 and the shaft 4, the conductive cloth 6 can achieve moderate contact pressure in the contact with the shaft 4 by bending of the conductive-cloth assy 8A and elastic deformation of the pressing member 7A at the holding portion 2*d* of the flange 2A, and this performance can be achieved by a very simple process of just making the slits 6*a* in the conductive cloth 6 and the slits 7*d* in the pressing member 7A. The conductive cloth 6 contains metal, but it is not a main material; therefore, an abnormal sound and conduction failure due to oxidation, which are problems in the conventional technologies, do not occur.

Furthermore, in the above-described configuration especially as shown in FIG. 13B, a compressed/deformed portion of the pressing member 7A is in contact with the holding portion 2*d* of the flange 2A and held by the holding portion 2*d*, so a portion of the conductive cloth 6 around the slits 6*a* in contact with the shaft 4 can have moderate stiffness, and is less likely to bend in a direction opposite to the insertion direction M of the shaft 4; moreover, as the width of the contact portion with the shaft 4 becomes smaller toward the center of the shaft 4, the contact pressure becomes lower, so a low-load electrification, such as grounding, configuration can be achieved. In this manner, the contact portion tapers toward the tip, so the tip portion is flexibly in contact with the shaft 4 but is pliant and hard to break.

First Modified Example of First Embodiment

Figure 15:
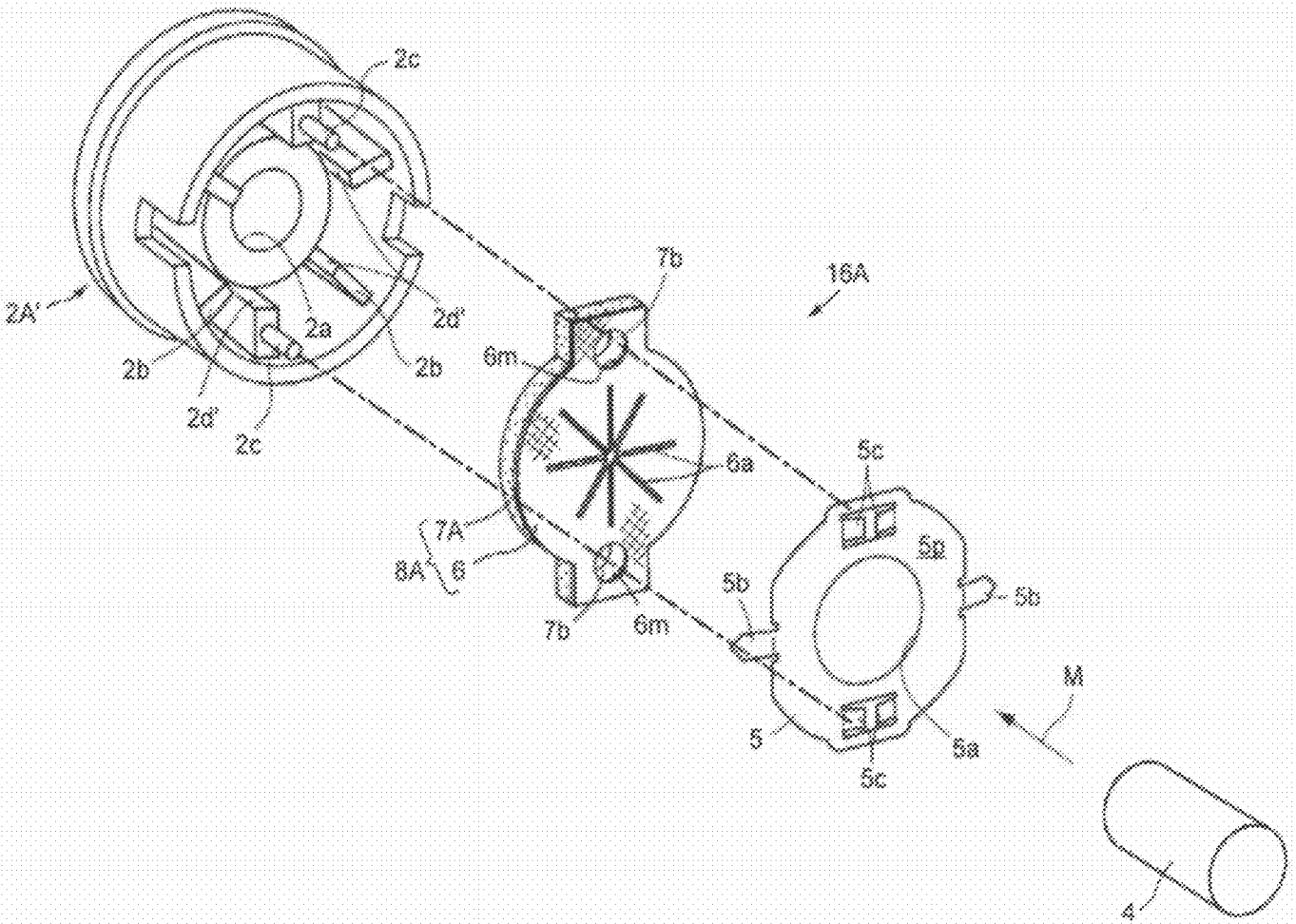
FIG. 15 is an exploded perspective view for explaining a configuration of a flange assy and an insert state of the shaft in a first modified example.

A first modified example of the first embodiment is explained with reference to FIG. 15. FIG. 15 is an exploded perspective view for explaining a configuration of a flange assy and an insert state of the shaft in the first modified example.

The first modified example differs from the first embodiment only in that a differently-shaped flange 2A' is used instead of the flange 2A. The flange 2A' differs from the flange 2A in the first embodiment only in that the flange 2A' uses a holding portion 2*d*'; the holding portion 2*d*' is that the inner wall surface of the holding portion 2*d* forming a ring-like space is cut out in a radial direction and a length direction of the shaft 4 and formed into a rib-like shape. It is obvious that the rib-shaped holding portion 2*d*' has the same effect as the holding portion 2*d*. Also in other embodiments described later, respective holding portions can be formed into a rib-like shape. The ribs of the holding portion 2*d*' are arranged so as to be out of phase with the slits of the conductive-cloth assy 8A, thereby the rib-shaped holding portion 2*d*' can come in contact with the pressing member 7A and hold the pressing member 7A when the slits of the conductive-cloth assy 8A bend/flex due to insertion of the shaft 4.

Here, harmful effects of an increased pressing force of a pressing member are explained.

In a configuration in which a photoreceptor rotates around a shaft, a conductive cloth is in contact with the shaft and slides on the shaft. As described above, the conductive cloth is that conductive fibers containing metal are woven into a cloth, so the conductive cloth has a high lubricating property; however, with increased contact pressure, the conductive cloth could be worn. Furthermore, when a pressing force (contact pressure) with respect to the shaft is increased by compression of the pressing member, a frictional force between the shaft and the conductive cloth is increased, and rotation torque is increased. The increase in rotation torque may cause such a situation that depending on a rated output motor for driving the photoreceptor to rotate, the motor does not rotate due to lack of rotation torque; if a motor supporting high torque is mounted, this leads to effects on an image forming apparatus, such as an increase in cost and an increase in package space. Furthermore, the increase in frictional force causes not only the increase in rotation torque but also an increase in internal temperature of the photoreceptor. In a developing device of the image forming apparatus, the increase in temperature causes degradation of cleaning performance, such as slip-through of toner on the photoreceptor, and changes in developing performance, such as an increase in amount of toner transferred onto a portion of the photoreceptor corresponding to a blank part; therefore, to suppress the heat generation, it is preferable not to increase the contact pressure too high.

Moreover, if a deformation amount of the pressing member becomes greater, permanent deformation or plastic deformation of the pressing member occurs. Namely, when the pressing member, which is an elastic body, is deformed by the application of force, if the force is great, the pressing member goes into a state (a hysteresis state) in which the pressing member cannot be restored to the original shape even after being released from the force. In such a state, even if contact pressure is initially high and conduction is stable, the pressure may decrease with time and the conduction may become unstable. From the above, it is preferable not to set the contact pressure excessively high.

A Change in compression of a pressing member, which is an elastic body, and pressure is explained with reference to FIG. 16. As the pressing member, the unprocessed pressing member 7A before the slits 7*d* or the like shown in FIG. 14 are made therein is used.

Figure 16:
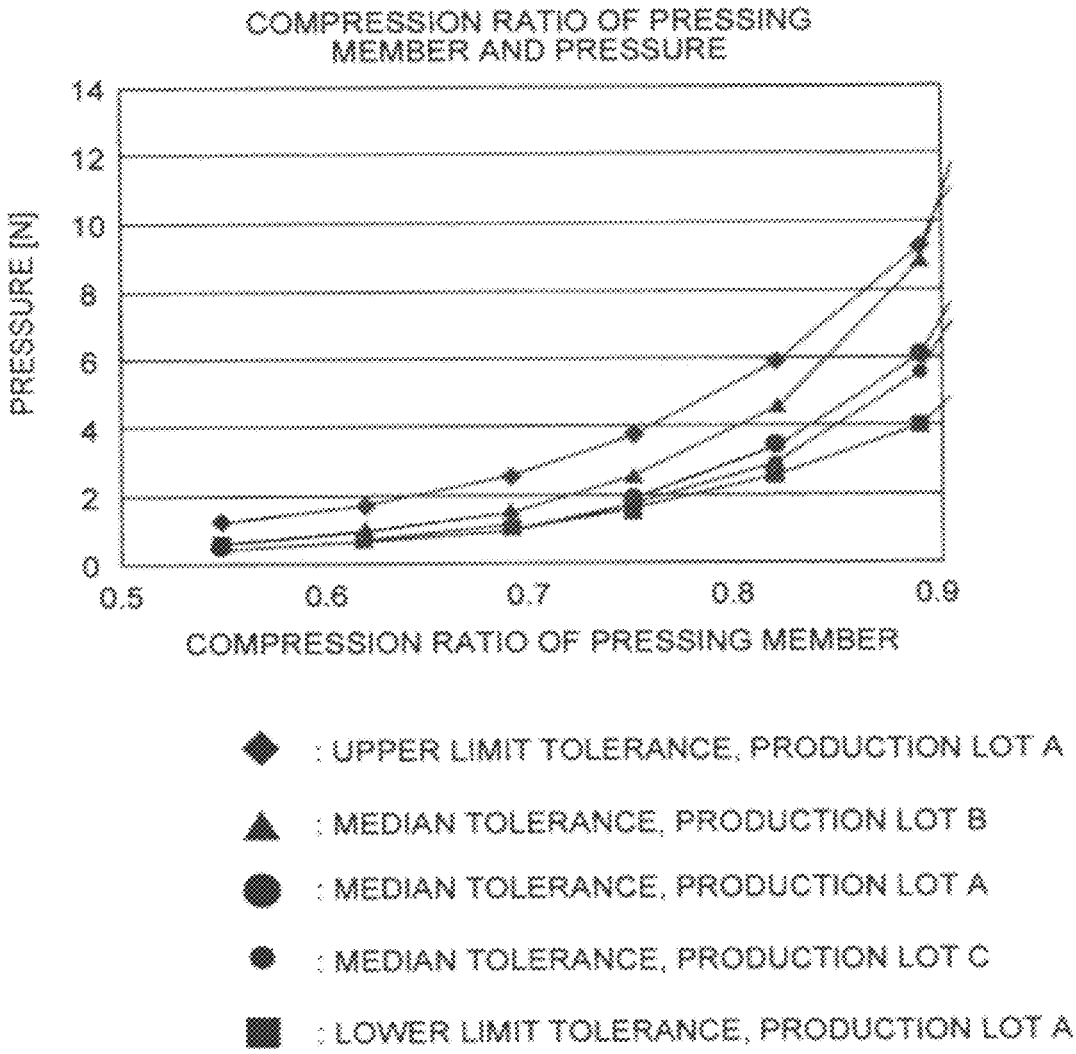
FIG. 16 is a graph showing a result of a compression test conducted for analyzing a relationship between a compression ratio of a pressing member and pressure.

FIG. 16 is a graph showing a result of a compression test conducted for analyzing a relationship between a compression ratio of a pressing member and pressure; the horizontal axis of the graph indicates a compression ratio of a pressing member and the vertical axis indicates pressure (N). Using urethane foam rubber (hereinafter, also referred to as "sponge") having an expansion ratio of about 40 as the pressing member, five different kinds of equally-sized test specimens were prepared in consideration of variations in dimensional tolerance and production lot, and the five test specimens were tested as parameters under the same test environmental conditions. As described at the bottom in FIG. 16, the five test specimens were prepared in different combinations of thickness tolerances, an upper limit tolerance, a median tolerance, and a lower limit tolerance, and production lots A, B, and C.

As shown in FIG. 16, the relationship between a compression ratio of the pressing member, which is an elastic body, and pressure never takes a linear shape. The graph in FIG. 16 shows a change in a compression ratio and pressure of an elastic body with respect to each of the equally-sized sponge test specimens. The compression ratio here means a ratio of a deformation amount to the original thickness; for example, when an elastic body with a thickness of 4 mm is deformed and compressed by 1 mm, i.e., compressed to 3-mm thick, a compression ratio of the elastic body is 0.25 (1 mm/4 mm). As shown in the graph, when a test specimen is compressed by more than a certain amount, resilience (pressure) of sponge increases rapidly. Depending on a material of an elastic body, if a compression ratio of the elastic body is more than 0 but not exceeding 0.7 (0<compression ratio≤0.7), there is no rapid increase in pressure, and the elastic body can be used in a state where a change rate thereof is virtually low. Furthermore, in view of a dimension error in component tolerance of each component, it is preferable to use an elastic body within the above-mentioned range of compression ratio. This also puts a pressing member into the above-described state in which the pressing member does not apply excessive pressure. Therefore, it is preferable to place the holding portion of the pressing member included in the flange member and set its shape size so that the pressing member has at least one portion where a compression ratio is more than 0 but not exceeding 0.7 (0<compression ratio≤0.7).

To bring the conductive cloth 6 into contact with the shaft 4, a flange member can have a multi-tiered shape tiered in a direction in which the conductive cloth 6 bends when the pressing member 7A, which is an elastic body composing the conductive-cloth assy 8A, bends/flexes from the base with the shaft 4 penetrating therethrough and is in contact with the shaft 4, and the multi-tiered flange member has a portion at which a distance from the flange member on the side of the conductive-cloth assy 8A to the center line 4*b* running the center of the shaft 4 is Larger than that is on the side of a bearing of the flange member holding the shaft 4 (the right end side in the drawing). Various embodiments, wherein a holding portion is shaped so that a distance from the center line of the shaft to the holding portion in the radial direction in the flange member becomes gradually larger toward the other end of the image carrier, are explained below.

Second Embodiment

Figure 17A:
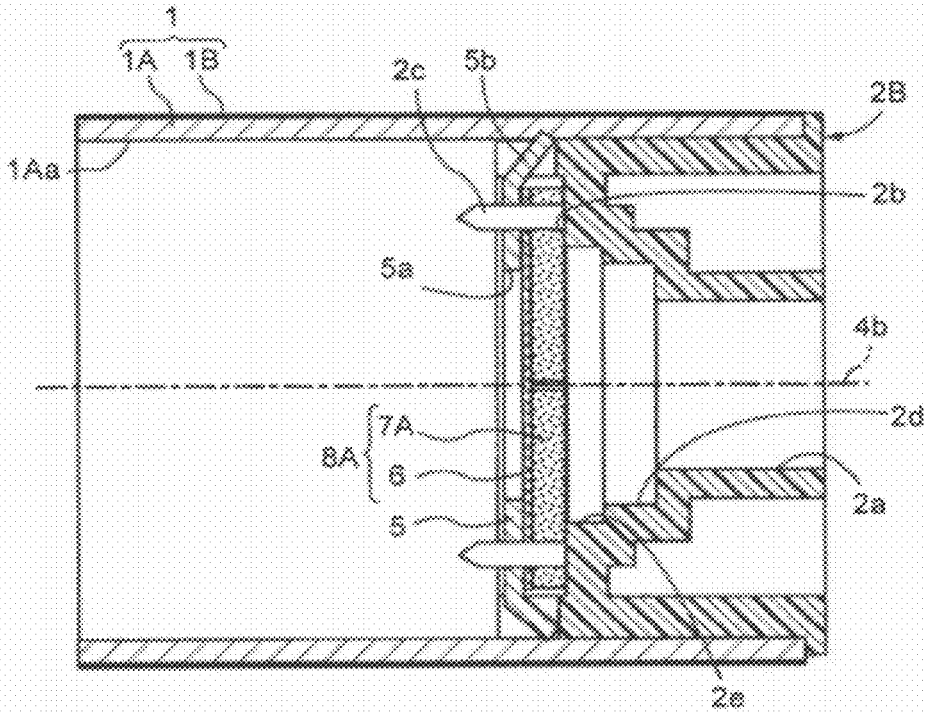
FIGS. 17A and 17B are cross-sectional views of one end portion of an image carrier unit in a second embodiment along the longitudinal direction (the axial direction), and show respective shapes and arrangement of components before and after insertion of the shaft, respectively.
Figure 17B:
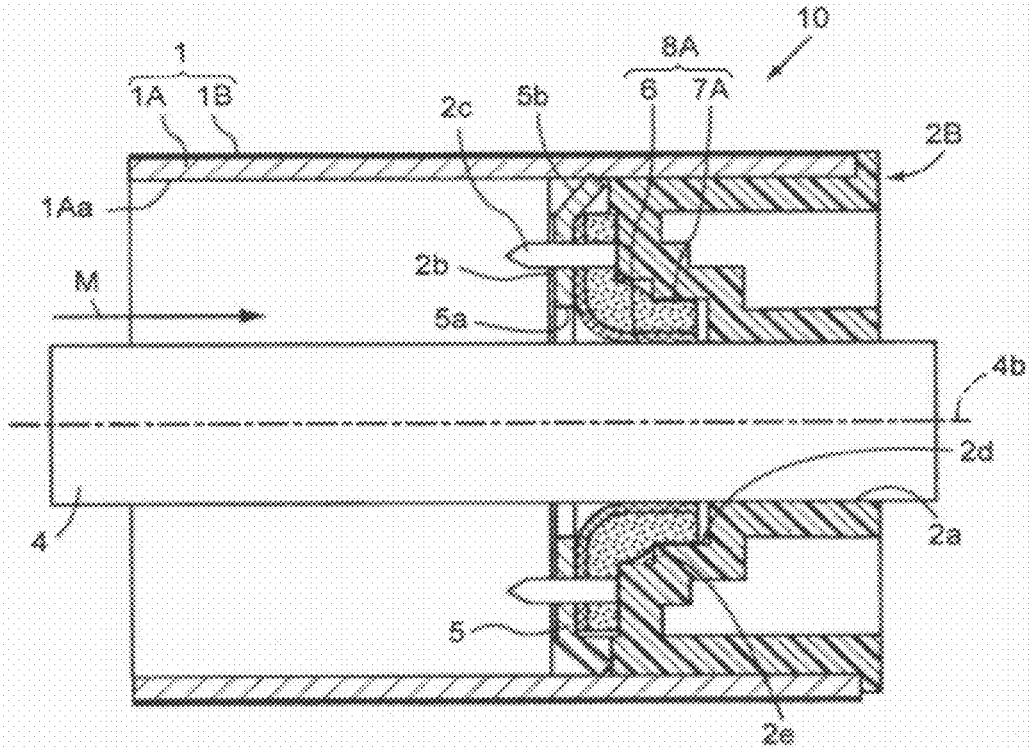

A second embodiment is explained with reference to FIGS. 17A and B. FIGS. 17A and B are a cross-sectional view of one end portion of the image carrier unit 10 in the second embodiment along the longitudinal direction (the axial direction). FIGS. 17A and 17B show respective shapes and arrangement of the image carrier 1, a flange 2B, the grounding plate 5, the conductive cloth 6, and the pressing member 7A before and after insertion of the shaft 4, respectively.

The second embodiment differs from the first embodiment shown in FIGS. 12 to 14 in that the differently-shaped flange 2B is used instead of the flange 2A. Except this difference, the image carrier unit 10 according to the second embodiment has the same configuration as that is in the first embodiment shown in FIGS. 12 to 14.

The flange 2B differs from the flange 2A in the first embodiment only in that the flange 2B has a holding portion 2*e* including an inner wall surface as a second contact holding portion in addition to the holding portion 2*d* as a first contact holding portion; the inner wall surface of the holding portion 2*e* is formed so that a distance from the center line 4*b* of the shaft 4 to the inner wall surface of the holding portion in the radial direction in the flange 2B becomes gradually larger toward the other end of the image carrier 1 (on the side of the gear 3 shown in FIGS. 3 and 4). Except this difference, the flange 2B has the same configuration as the flange 2A in the first embodiment. The holding portion 2*e* is connected to the holding portion 2*d*, and the inner wall surface of the holding portion 2*e* is cut off to form a tiered ring-like space extending in the radial direction so as to form a space larger than the size of the holding portion 2*d* in the radial direction.

To bring the conductive cloth 6 into contact with the shaft 4, as shown in FIG. 17B, when the conductive cloth 6 of the conductive-cloth assy 8A bends/flexes from the base with the shaft 4 penetrating therethrough and is in contact with the shaft 4, in the holding portion 2*d* of the flange 2B in which a compressed/deformed portion of the pressing member 7A is housed, the conductive cloth 6 is in contact with the shaft 4 in a state where the pressing member 7A is compressed by a certain amount. In the tiered holding portion 2*e*, the conductive cloth 6 is in contact with the shaft 4 in a state where compressive deformation (a compression ratio) of the pressing member 7A is small because the holding portion 2*e* is farther away from the center line 4*b* of the shaft 4 in the radial direction than the holding portion 2*d*. A distance to the shaft 4 in the holding portion 2*e* does not have to be a distance at which sponge of the pressing member 7A is compressed. Namely, the conductive cloth 6 does not have to be in contact with the shaft 4 in the holding portion 2*e* as a second contact holding portion, and the holding portion 2*e* can be shaped not to compress/deform the sponge of the pressing member 7A. In this manner, a tiered ring-like space is formed by the two consecutively-connected holding portions 2*d* and 2*e*, so in the holding portion 2*e* closer to the side of the conductive cloth 6, compression of the pressing member 7A is weaker than the back-side holding portion 2*d* or there is no compression of the pressing member 7A.

When the conductive-cloth assy 8A flexes and is in contact with the shaft 4, a compression ratio of the pressing member 7A is low at the flexed base portion, and a compression ratio of the pressing member 7A is high at the tip of the conductive cloth 6. When incorporating the shaft 4 into the photoreceptor which is the image carrier 1, the shaft 4 is inserted from the side of the gear 3 equipped with the conductive cloth 6, i.e., the inside of the flange 2B; at this time, the tip of the shaft 4 first enters a bearing (not shown) on the opposite side (i.e., on the side of the other gear 3 at the other end of the image carrier 1), and passes through a hollow portion of an original pipe of the photoreceptor, and then enters a bearing (the hole 2*a*) of the flange 2B attached with the conductive-cloth assy 8A. When the tip of the shaft 4 is inserted into the conductive-cloth assy 8A while pushing the slits 6*a* and 7*d* made in the conductive-cloth assy 8A, in the first embodiment, the pressing member 7A is immediately compressed to a predetermined thickness, so a rapid change in load occurs at the time of insertion of the shaft 4. Therefore, the assembly workability is down. However, in the present embodiment, the flange 2B is formed to reduce pressure of sponge of the pressing member 7A on the side of the conductive cloth 6; therefore, the difficulty of inserting the shaft 4 can be reduced, and the assembly performance can be enhanced.

As described above with reference to FIG. 13, when the shaft 4 is inserted into the photoreceptor, which is the image carrier 1, in the insertion direction M, after penetrating through a hollow original pipe of the photoreceptor, the shaft 4 enters the bearing of the flange 2A attached with the conductive cloth 6; in normal assembly, the shaft 4 is inserted after the position of the shaft 4 is subtly adjusted so as to fit the tip of the shaft 4 into the distal-side hole 2*a* of the flange 2A. In such an assembling method, if there is no guide in the hole 2*a* of the flange 2A into which the shaft 4 is inserted, the shaft 4 has to be positioned in the center of the hole 2*a*. However, in the first embodiment, the inside diameter of the holding portion 2*d* in contact with the sponge of the pressing member 7A in the conductive-cloth assy 8A is basically formed to be the same diameter as the hole 2*a*; therefore, if the center of the shaft 4 does not fit the center of the hole 2*a*, it is difficult to insert the shaft 4.

On the other hand, in the second embodiment, the tiered holding portion 2*e* larger than the holding portion 2*d* is provided on the mounting surface on which the conductive-cloth assy 8A is mounted, thereby giving the function of a kind of guide member to the holding portion 2*e*. Therefore, when the shaft 4 is inserted in the insertion direction M, the shaft 4 is inserted toward the large tiered holding portion 2*e* with the guide function; therefore, even if the shaft 4 deviates from the center of the flange 2B into which the shaft 4 is supposed to be inserted, the shaft 4 first enters the tiered portion of the holding portion 2*e* serving as a guide, so the shaft 4 can be guided into the center. Consequently, it is easy to insert the shaft 4, and the assembly performance and the workability can be enhanced.

Furthermore, when the flexible, plate-like conductive-cloth assy 8A is brought into contact with the pillar-shaped shaft 4, the bent/flexed base portion of the conductive-cloth assy 8A is crinkled, and the conductive-cloth assy 8A is likely to become loose from the mounting surface of the flange member. Also in this state, i.e., when the flexed base portion of the conductive-cloth assy 8A is crinkled, a space is formed in the flexed base portion by the holding portion 2*e*, so the crinkled portion can be kept as it is, i.e., is not squeezed; therefore, it is possible to prevent loosening of the conductive-cloth assy 8A. Such prevention of loosening and prevention of an increase in pressure on a part make it possible to maintain the contact with the grounding plate 5 that pushes the conductive cloth 6 over time. The load on the caulked portion of the bosses 2*c* of the flange 2B that fixes the grounding plate 5 is reduced, and thus, it is also possible to prevent caulking of the grounding plate 5 in the flange 2B from being loosened. The caulked portion of the grounding plate 5 in the flange 2B is for reliably making the grounding plate 5 and the conductive cloth 6 stick together, so, if this portion is loosened, conduction between them becomes unstable; however, in the present embodiment, as described above, caulking of the grounding plate 5 can be prevented from being loosened over time, so it is possible to ensure the stable conduction over time.

Third Embodiment

Figure 18A:
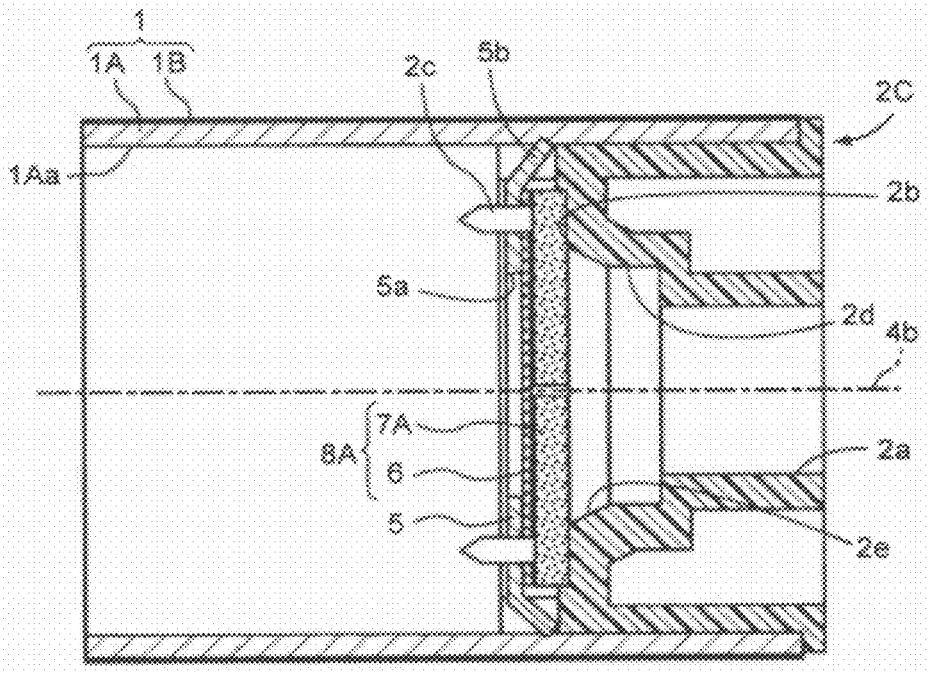
FIGS. 18A and 18B are cross-sectional views of one end portion of an image carrier unit in a third embodiment along the longitudinal direction (the axial direction), and show respective shapes and arrangement of components before and after insertion of the shaft, respectively.
Figure 18B:
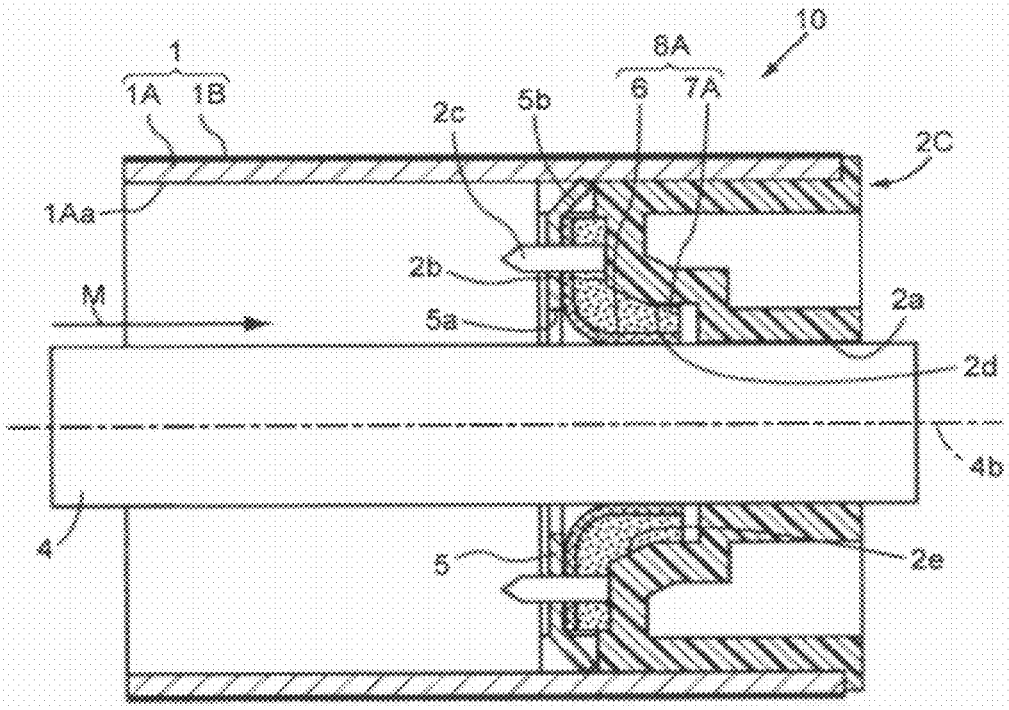

A third embodiment is explained with reference to FIGS. 18A and B. FIGS. 18A and B are a cross-sectional view of one end portion of the image carrier unit 10 in the third embodiment along the longitudinal direction (the axial direction); FIGS. 18A and 18B shows respective shapes and arrangement of the image carrier 1, a flange 2C, the grounding plate 5, the conductive cloth 6, and the pressing member 7A before and after insertion of the shaft 4, respectively.

The third embodiment differs from the second embodiment shown in FIGS. 17A and B in that the differently-shaped flange 2C is used instead of the flange 2B. Except this difference, the image carrier unit 10 according to the third embodiment has the same configuration as that is in the second embodiment shown in FIGS. 17A and B.

The flange 2C differs from the flange 2B in the second embodiment only in that a portion of the inner wall surface of the holding portion 2*e* connected to the holding portion 2*d* is inclined so that a distance from the center line 4*b* of the shaft 4 to the inner wall surface of the holding portion 2*e* in the radial direction in the flange 2C becomes gradually larger toward the other end of the image carrier 1 (on the side of the gear 3 shown in FIGS. 3 and 4). The functional feature of the holding portion 2*e* in the flange 2C is identical to that of the holding portion 2*e* in the above second embodiment, and the holding portion 2*e* in the flange 2C produces the same effect as that is in the second embodiment.

A portion of the inner wall surface of the holding portion 2*e* connected to the holding portion 2*d* is inclined; therefore, in space between the shaft 4 and the flange 2C when the shaft 4 is inserted into the bearing hole 2*a*, a space between the inner wall surface of the holding portion 2*d* and the shaft 4 is narrowest, and becomes gradually larger from the inclined portion of the holding portion 2*e* angled to the holding portion 2*d* toward the side of the conductive-cloth assy 8A. The thickness of the pressing member 7A attached to the conductive cloth 6 is constant; therefore, when the conductive-cloth assy 8A including the pressing member 7A bends/flexes in accordance with the insertion of the shaft 4, a distance between the shaft 4 and a contact surface of the pressing member 7A in the conductive-cloth assy 8A varies, thereby a compression ratio of the sponge of the pressing member 7A is changed, so that pressure on the side of the conductive-cloth assy 8A, i.e., the side from which the shaft 4 is inserted is low, and pressure gradually increases from the holding portion 2*e* toward the holding portion 2*d* on the side of the hole 2*a*. Therefore, resistance to the shaft 4 when the shaft 4 is inserted is weakened, so the assembly workability can be further enhanced.

Fourth Embodiment

Figure 19A:
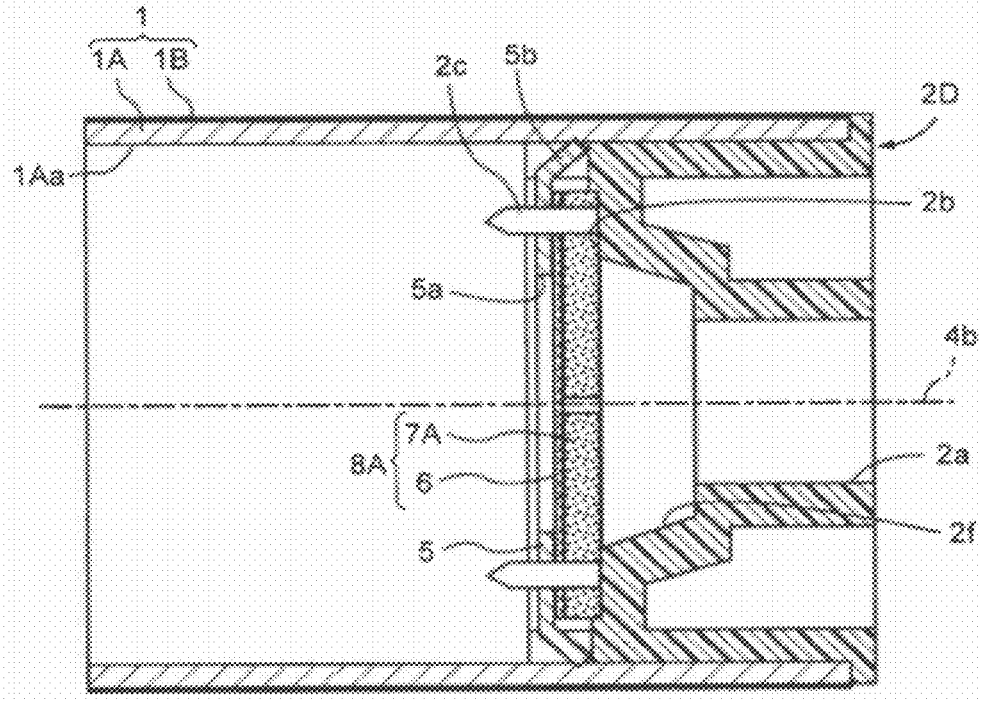
FIGS. 19A and 19B are cross-sectional views of one end portion of an image carrier unit in a fourth embodiment along the longitudinal direction (the axial direction), and show respective shapes and arrangement of components before and after insertion of the shaft, respectively.
Figure 19B:
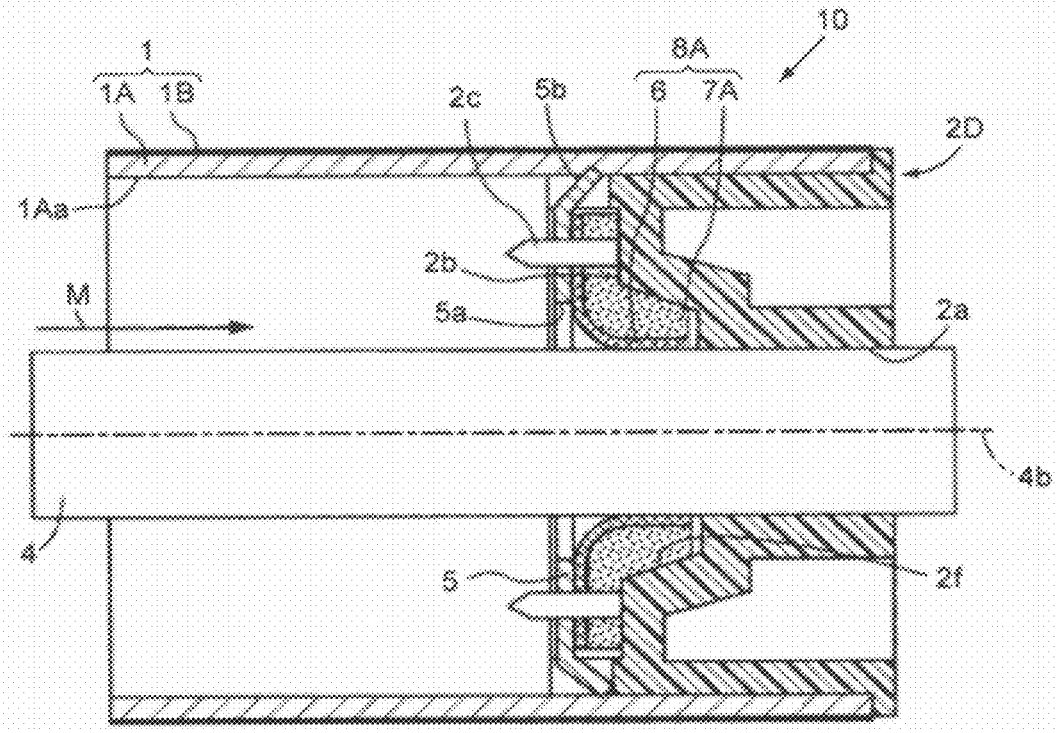

A fourth embodiment is explained with reference to FIGS. 19A and B. FIGS. 19A and B are a cross-sectional views of one end portion of the image carrier unit 10 in the fourth embodiment along the longitudinal direction (the axial direction); FIGS. 19A and 19B shows respective shapes and arrangement of the image carrier 1, a flange 2D, the grounding plate 5, the conductive cloth 6, and the pressing member 7A before and after insertion of the shaft 4, respectively.

The fourth embodiment differs from the third embodiment shown in FIGS. 18A and B in that the differently-shaped flange 2D is used instead of the flange 2C. Except this difference, the image carrier unit 10 according to the fourth embodiment has the same configuration as that is in the third embodiment shown in FIGS. 18A and B.

The flange 2D differs from the flange 2C shown in FIGS. 18A and B mainly in that the flange 2D has a holding portion 2*f* instead of the holding portions 2*d* and 2*e*; the holding portion 2*f* has an inclined inner wall surface of which the cross-sectional area becomes gradually smaller toward the downstream side of the insertion direction M of the shaft 4. In the holding portion 2*f*, a portion having a largest space between the outer circumferential surface of the shaft 4 and the inner wall surface of the holding portion 2*f* is the side of the mounting surface on which the conductive cloth 6 is mounted, and a portion having a narrowest space between them is the opposite side, i.e., the side of the surface adjacent to the bearing hole 2*a*. Namely, if the inner wall surface of the holding portion 2*f* is cut along the plane including the center line 4*b* of the shaft 4, the cut plane has an isosceles trapezoid shape. In contrast to the isosceles trapezoidal holding portion 2*e* in the third embodiment shown in FIGS. 18A and B, an inclined portion of the inner wall surface of the holding portion 2*f* holds a compressed portion of the pressing member 7A across the full width thereof, and therefore, an angle between the inclined portion of the inner wall surface of the holding portion 2*f* and the shaft 4 can be reduced. Therefore, a compressive deformation state of the pressing member 7A gently changes.

In the fourth embodiment, there is no horizontal portion in the inner wall surface of the holding portion 2*f*, so a pressure deviation is caused by compressive deformation of the pressing member 7A. Therefore, a portion of the inner wall surface holding a compressed portion of the pressing member 7A is inclined as gently as possible, so that the pressure deviation is reduced. An appropriate compressive force (pressure) of the sponge of the pressing member 7A is set on the basis of a gradient of a change in pressure with respect to a compression ratio of the sponge and contact pressure on the conductive cloth 6 which is required to achieve the stable conduction. Such pressure should be within a certain range of pressure, so the inclination of the surface in the above-described shape just has to be set to meet the range of pressure. This makes it possible to widen a part into which the shaft 4 is inserted by application of appropriate pressure within the range and also possible to satisfy both ease of inserting the shaft 4 and stabilization of contact pressure.

Fifth Embodiment

Figure 20A:
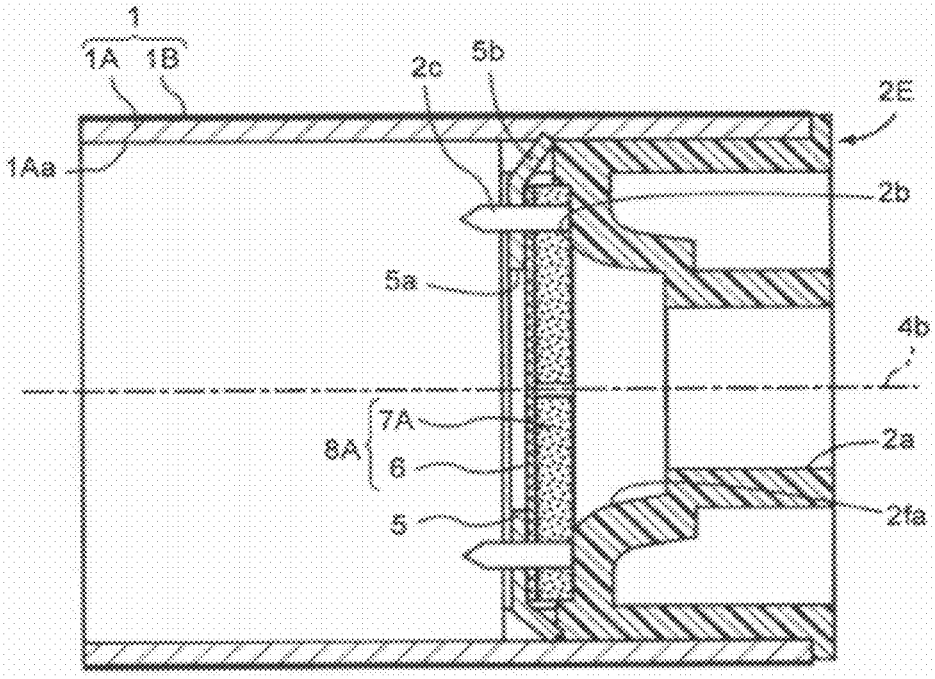
FIGS. 20A and 20B are cross-sectional views of one end portion of an image carrier unit in a fifth embodiment along the longitudinal direction (the axial direction), and show respective shapes and arrangement of components before and after insertion of the shaft, respectively.
Figure 20B:
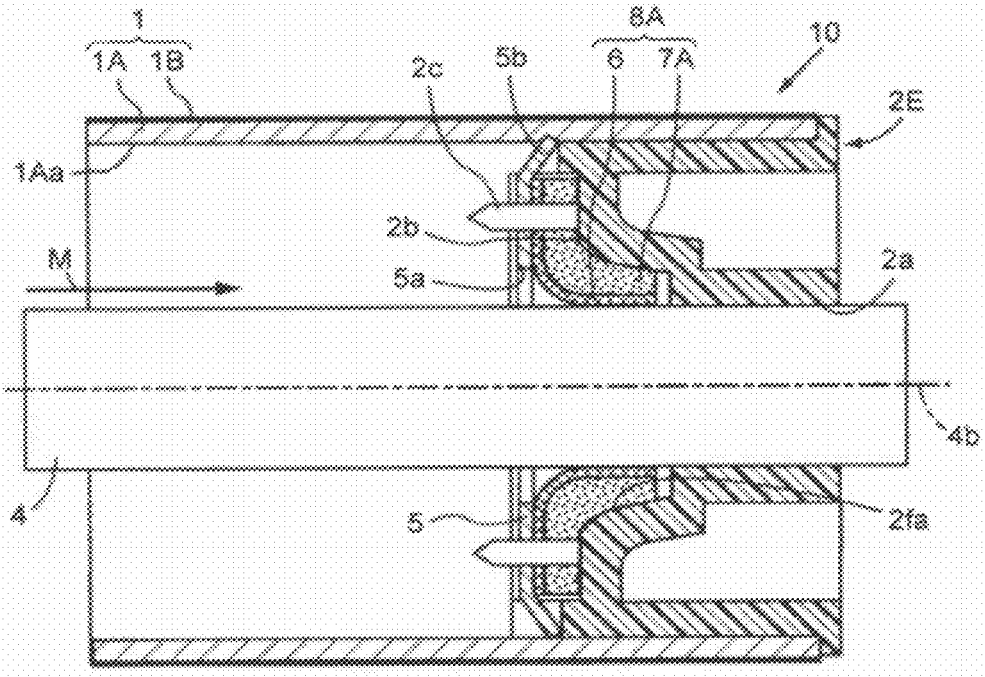

A fifth embodiment is explained with reference to FIGS. 20A and B. FIGS. 20A and B are cross-sectional views of one end portion of the image carrier unit 10 in the fifth embodiment along the longitudinal direction (the axial direction); FIGS. 20A and 20B shows respective shapes and arrangement of the image carrier 1, a flange 2E, the grounding plate 5, the conductive cloth 6, and the pressing member 7A before and after insertion of the shaft 4, respectively.

The fifth embodiment differs from the fourth embodiment shown in FIGS. 19A and B in that the differently-shaped flange 2E is used instead of the flange 2D. Except this difference, the image carrier unit 10 according to the fifth embodiment has the same configuration as that is in the fourth embodiment shown in FIG. 19.

The flange 2E differs from the flange 2D shown in FIG. 19 mainly in that the flange 2E has a holding portion 2*fa* having a gently-curved inner wall surface instead of the holding portion 2*f*. The holding portion 2*fa* has a gently-curved surface connecting the inner end of the hole 2*a* and the mounting surface 2*b* on which the conductive-cloth assy 8A is mounted. As shown in FIG. 20, the tangent to the curve near the side of the bearing surface of the hole 2*a* is at an angle almost parallel to the center line 4*b* of the shaft 4, and from that position, an angle between the tangent to the curve and the center line 4*b* of the shaft 4 becomes gradually larger toward the side of the conductive cloth 6.

As compared with the holding portion 2*f* in the fourth embodiment shown in FIG. 9, a portion of the holding portion 2*fa* near the hole 2*a* is at an angle almost parallel to the center line 4*b* of the shaft 4; therefore, around the holding portion 2*fa* near the hole 2*a*, there is little change in a compression ratio of the sponge of the pressing member 7A. Namely, in a portion of the holding portion 2*fa* near the hole 2*a*, the pressing member 7A can be compressed at an intended median compression ratio of the sponge of the pressing member 7A and brought into contact with the holding portion 2*fa*. In addition, in the holding portion 2*fa* on the side of the mounting surface 2*b* on which the conductive-cloth assy 8A is mounted, an angle between the tangent to the curve and the center line 4*b* of the shaft 4 is large, and the holding portion 2*fa* is away from the outer circumferential surface of the shaft 4, so pressure of the sponge of the pressing member 7A is reduced, and the opening widens, and therefore, it becomes easier to insert the shaft 4. In this manner, in the present embodiment, resistance to the shaft 4 due to compression of the pressing member 7A after insertion of the shaft 4 gradually varies but is weakened at an inlet portion of the holding portion 2*fa* in the insertion direction M of the shaft 4, and a compression ratio of the sponge of the pressing member 7A becomes an intended median compression ratio near the hole 2*a* of the holding portion 2*fa*; therefore, a cumulative effect of component tolerances is less likely to occur, and the stable pressure can be maintained, thereby the stable conduction can be ensured over time.

Sixth Embodiment

Figure 21:
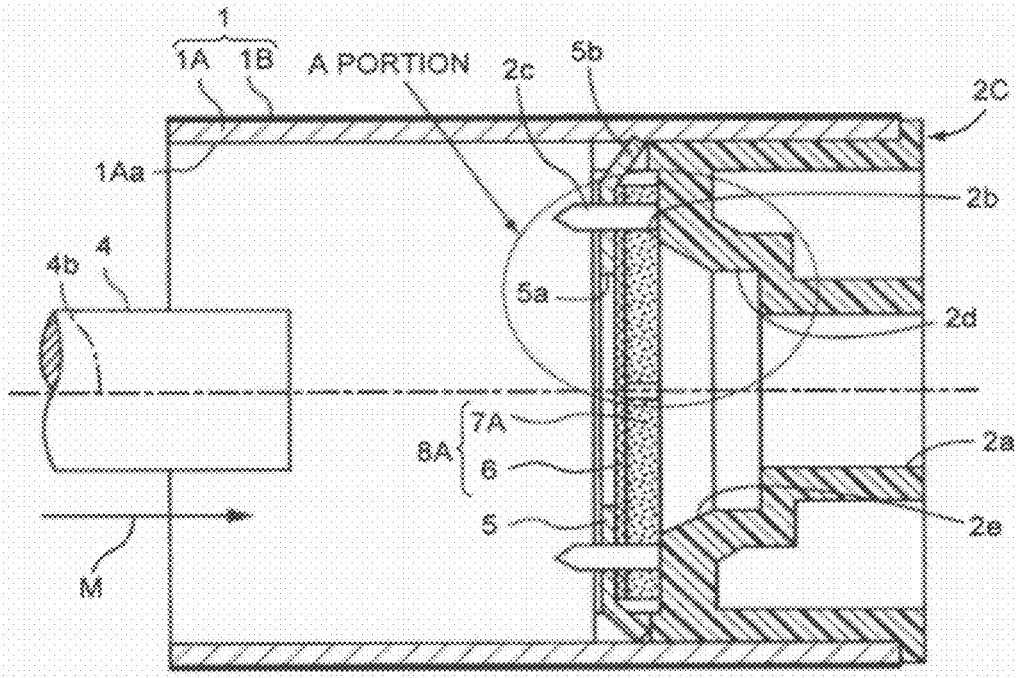
FIG. 21 is a cross-sectional view of one end portion of the image carrier unit in the third embodiment along the longitudinal direction (the axial direction) as an example for explaining a sixth embodiment.
Figure 22:
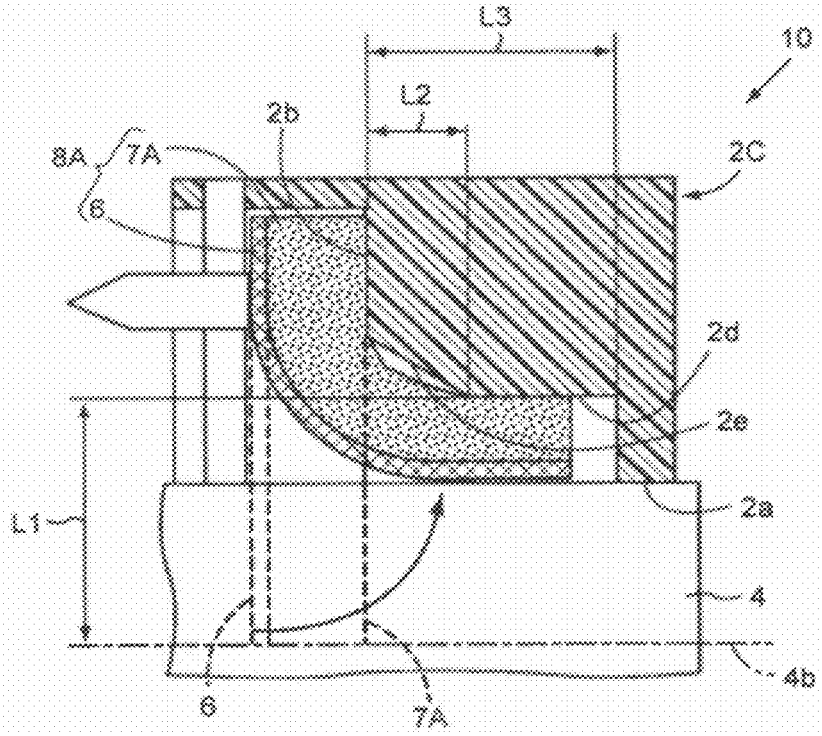
FIG. 22 is an enlarged cross-sectional view of a part A shown in FIG. 21, and shows changes in shape of the conductive cloth and the pressing member in a state of L3>L1>L2.
Figure 23:
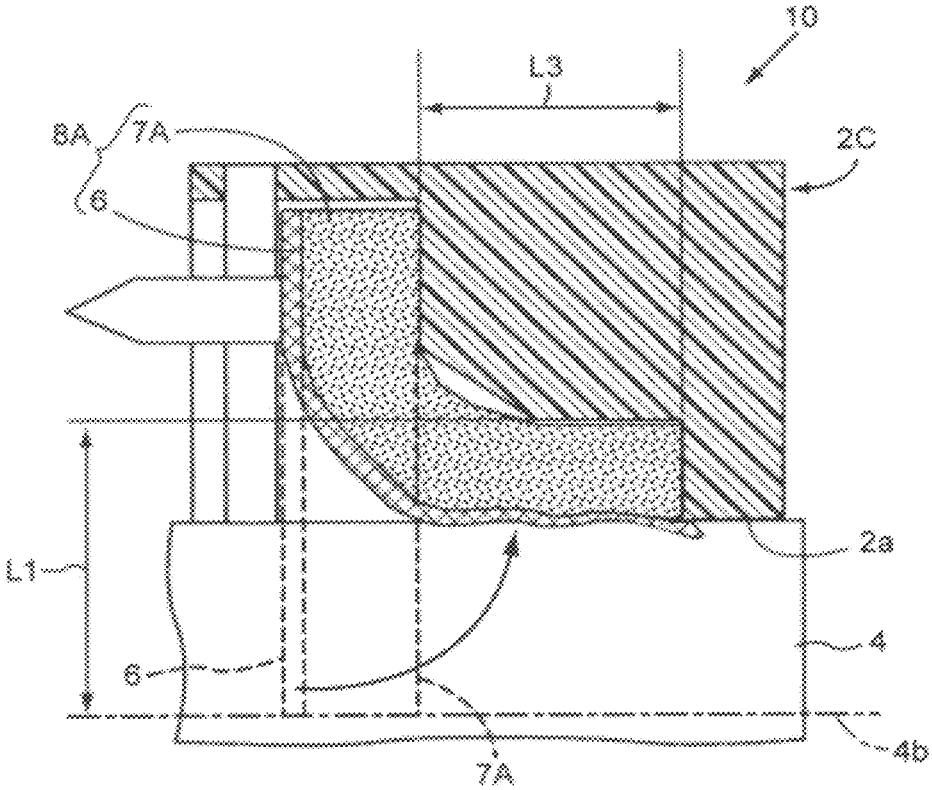
FIG. 23 is an enlarged cross-sectional view of the part A shown in FIG. 21, and shows changes in shape of the conductive cloth and the pressing member in a state of L3<L1 (case 1)
Figure 24:
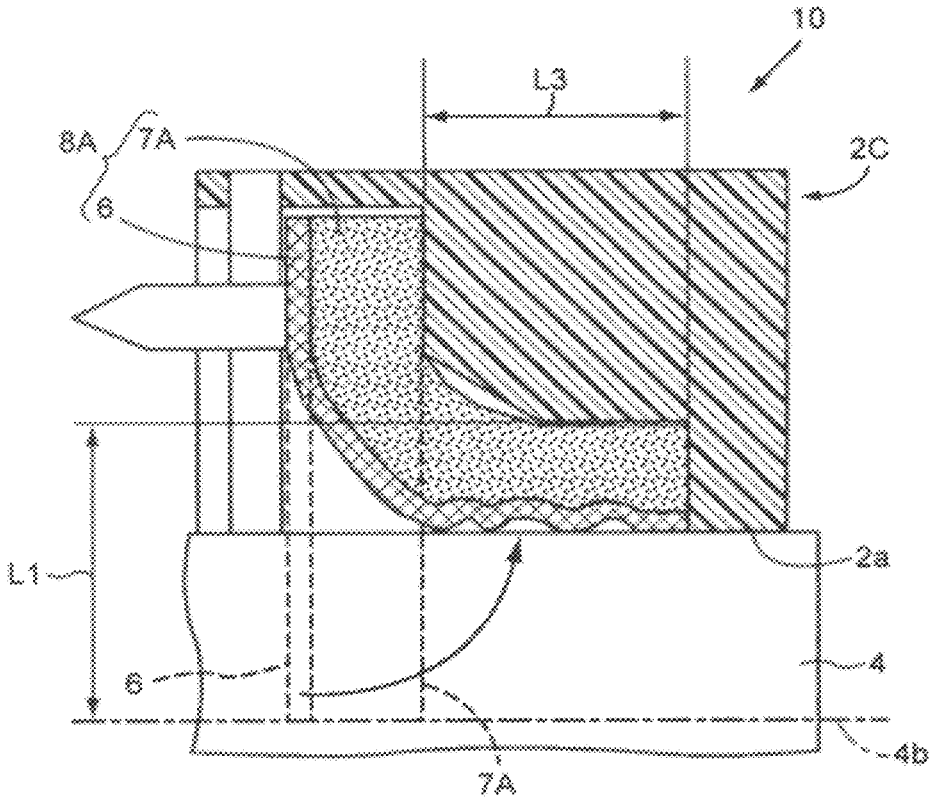
FIG. 24 is an enlarged cross-sectional view of the part A shown in FIG. 21, and shows changes in shape of the conductive cloth and the pressing member in the state of L3<L1 (case 2)

A sixth embodiment is explained with reference to FIGS. 21 to 24. FIG. 21 is a cross-sectional view of one end portion of the image carrier unit 10 in the third embodiment along the longitudinal direction (the axial direction) as an example for explaining the sixth embodiment. FIG. 22 is an enlarged cross-sectional view of a part A shown in FIG. 21, and shows changes in shape of the conductive cloth 6 and the pressing member 7A in a state of L3>L1>L2. FIG. 23 is a cross-sectional view showing changes in shape of the conductive cloth 6 and the pressing member 7A in a state of L3<L1 (case 1). FIG. 24 is a cross-sectional view showing changes in shape of the conductive cloth 6 and the pressing member 7A in the state of L3<L1 (case 2).

The sixth embodiment defines a relationship between the shape size of the holding portion 2*d* of the flange 2C and changes in shape of the conductive cloth 6 and the pressing member 7A taking the above-described third embodiment as an example.

As is the case in the third embodiment described above with reference to FIG. 18, in FIG. 21, when the shaft 4 is inserted from the insertion direction M on the side of the other end of the image carrier 1 (on the side of the gear 3 shown in FIGS. 3 and 4), the shaft goes into the slits 6*a* and 7*d* made in the conductive-cloth assy 8A, and the conductive cloth 6 is in contact with the shaft 4 while bending/flexing to the same direction M as the insertion direction of the shaft 4. Toward the hole 2*a* through which the shaft 4 penetrates, the flange 2C has the holding portion 2*d* on the side of the mounting surface 2*b* on which the conductive-cloth assy 8A is mounted; the holding portion 2*d* compresses the slits 7*d* made in the pressing member 7A of the conductive-cloth assy 8A, thereby bringing the conductive cloth 6 into contact with the shaft 4.

In FIG. 22, it is preferable to set the respective shape sizes of the components of the flange 2C to satisfy L2<L1<L3, where L1 denotes a distance from the center line 4*b* of the shaft 4 to the inner wall surface of the holding portion 2*d* in the radial direction in the flange 2C, L2 denotes a distance from the mounting surface 2*b* of the flange 2C on which the conductive-cloth assy 8A is mounted (the pressing member 7A is mounted) to the start edge of the holding portion 2*d* in the length direction of the shaft 4, and L3 denotes a distance from the mounting surface 2*b* of the flange 2C on which the conductive-cloth assy 8A is mounted to the end edge of the holding portion 2*d* in the length direction of the shaft 4 (the junction of the holding portion 2*d* and the hole 2*a*).

The holding portion 2*d* is a part to which the pressing member 7A of the conductive-cloth assy 8A is compressed when the shaft 4 is inserted; therefore, for example, in the flange 2A in the first embodiment shown in FIG. 13, L2 is zero.

Conditions of L1, L2, and L3 in the case as defined above are explained below.

(1) An example of a state of L3>L1 is explained with reference to FIG. 22.

In the conductive-cloth assy 8A, the pressing member 7A made of an elastic body, such as sponge, is taped to the conductive cloth 6. Although the pressing member 7A is substantially thick, in a state where the slit portion of the conductive-cloth assy 8A bends due to the insertion of the shaft 4 into the conductive-cloth assy 8A, a part around the base of the bent portion may be deformed to take a nearly flexed posture. Then, due to compression of the pressing member 7A in practice, the bent/flexed portion of the conductive cloth 6 comes close to the mounting surface 2*b* of the flange 2C on which the conductive-cloth assy 8A is mounted; therefore, to prevent the tip of the conductive cloth 6 from reaching around the hole 2*a*, which rotatably holds the shaft 4, when the conductive cloth 6 is in contact with the shaft 4, the flange 2C has to be spaced from the conductive cloth 6 at a distance equal to the length from the base of the bent/flexed portion excluding the thickness of the pressing member 7A to the tip of the conductive cloth 6 (corresponding to the center line 4*b* of the shaft 4).

(2) An example of a state of L3<L1 (case 1) is explained with reference to FIG. 23. Under the condition as shown in FIG. 23, the tip of the slit made in the conductive cloth 6 reaches the inlet of the bearing (the hole 2*a*) of the flange 2C, and enters into the hole 2*a* when the shaft 4 is inserted, and this causes a trouble that the slit gets stuck between the inner wall of the hole 2*a* and the shaft 4.

(3) An example of a state of L3<L1 (case 2) is explained with reference to FIG. 24. If the tip of the slit made in the conductive cloth 6 reaches the bearing (the hole 2*a*) of the flange 2C and is in contact with the wall surrounding the bearing, as there is not enough space to house the conductive cloth 6, the conductive cloth 6 is ruffled, and this causes a trouble that an area of contact with the shaft 4 is decreased. Namely, the stability of conduction is degraded.

(4) An example of a state of L2<L1 is explained with reference to FIG. 22. In a state where the slit portion of the conductive cloth 6 is in contact with the shaft 4 due to above-described compression of the pressing member 7A of the conductive-cloth assy 8A at the time of attachment, the pressing member 7A compressed at the base of the bent/flexed portion, so a distance from the mounting surface 2*b* on which the conductive-cloth assy 8A is mounted to the tip of the slit of the conductive cloth 6 is about L1. Therefore, to compress the pressing member 7A taped to the conductive cloth 6, the start edge of the holding portion 2*d* has to be located on the inside of the tip of the slit of the conductive cloth 6, and the distance L2 has to be shorter than L1.

Modified examples of the differently-shaped conductive cloth are explained with reference to FIGS. 25 to 27.

Figure 25:
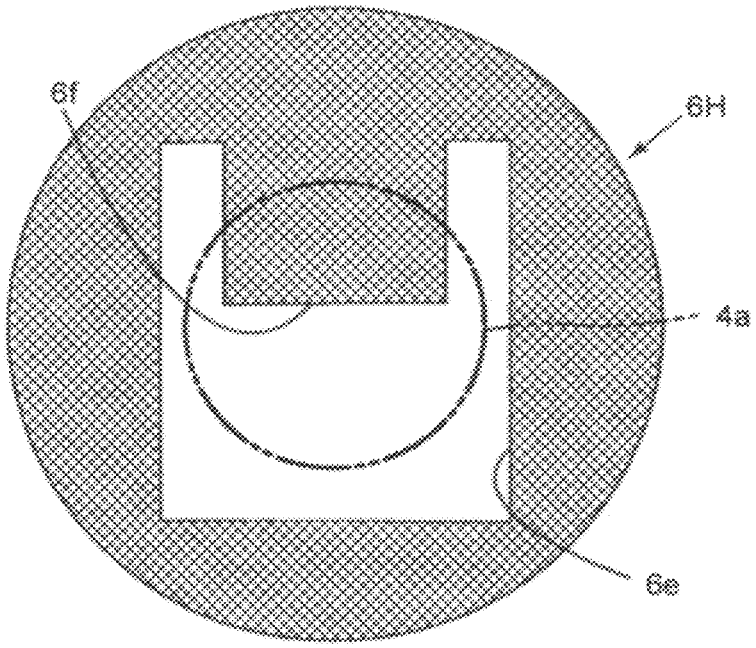
FIG. 25 is a front view showing a modified example of the shape of the conductive cloth.

A conductive cloth 6H shown in FIG. 25 differs from the conductive cloth 6 in which the slits 6*a* are made in a radial fashion as shown in FIG. 13, etc. mainly in that the conductive cloth 6H has a cutout 6*e* including a contact region 6*f* as shown in FIG. 25; the cutout 6*e* enables insertion/penetration of the shaft 4 and causes the conductive cloth 6H to bend and be in contact with the shaft 4 when the shaft 4 is inserted. The contact region 6*f* has a simple rectangular shape, and is integrally formed on the conductive cloth 6H as if the contact region 6*f* were hanging down from an upper portion of the cutout 6*e*. Incidentally, in FIGS. 25 to 27, a part 4*a* circled with a virtual line indicates the shape of the outside diameter of the shaft 4 as the shape of a cross-section of the shaft 4 when the shaft 4 penetrates through the conductive cloth 6H. A reference numeral 4*c* in FIG. 26 indicates the shaft center.

In various conductive cloths with a "cutout" including the conductive cloth 6H, the shape of the "cutout" is designed so that a range of contact with the shaft 4 and contact pressure can be adjusted with a high degree of accuracy. In the conductive cloth 6H, an area of the conductive cloth 6H other than the contact region 6*f* of the cutout 6*e* and the shaft 4 is in contact with the shaft 4 and the flat plate portion 5*p* of the grounding plate 5; therefore, conduction between the shaft 4 and the grounding plate 5 can be ensured via the conductive cloth 6H.

Figure 26:
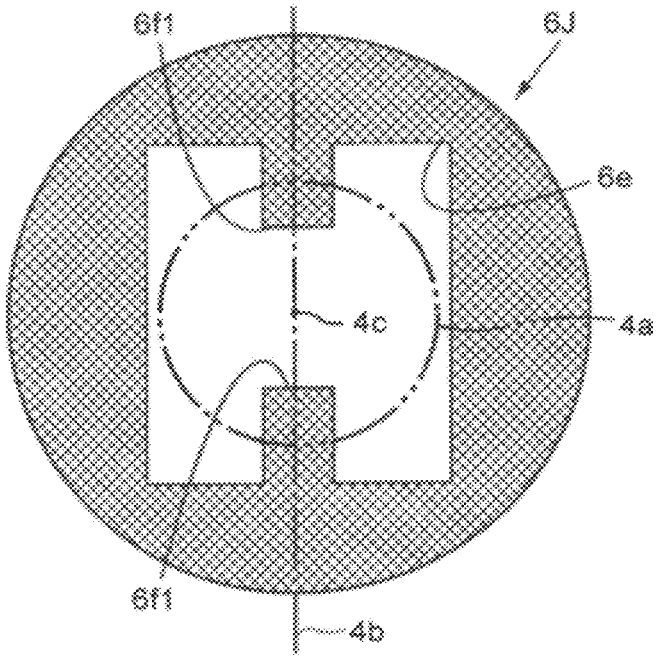
FIG. 26 is a front view showing another modified example of the shape of the conductive cloth.

A conductive cloth 6J shown in FIG. 26 differs from the conductive cloth 6H shown in FIG. 25 only in that the conductive cloth 6J has a plurality of (two, in this modified example) contact regions 6*f*1 of which the contact area is smaller than that of the contact region 6*f* as shown in FIG. 26; in this example, the contact regions 6*f*1 are symmetrically arranged with respect to the center line 4*b* running the shaft center 4*c*, and one of the contact regions 6*f*1 is placed as if the contact region 6*f*1 were hanging down from an upper portion of the cutout 6*e*, and the other contact region 6*f*1 is placed as if the contact region 6*f*1 were projecting from a lower portion of the cutout 6*e*.

Although the conductive cloth 6J has a simple shape, the number of points of contact between the shaft 4 and the conductive cloth 6J is increased, so it is possible to ensure the stable conduction. Incidentally, in the example shown in FIG. 26, the contact regions 6*f*1 are symmetrically arranged with respect to the center line 4*b*; however, the contact regions 6*f*1 can be arbitrarily arranged.

Figure 27:
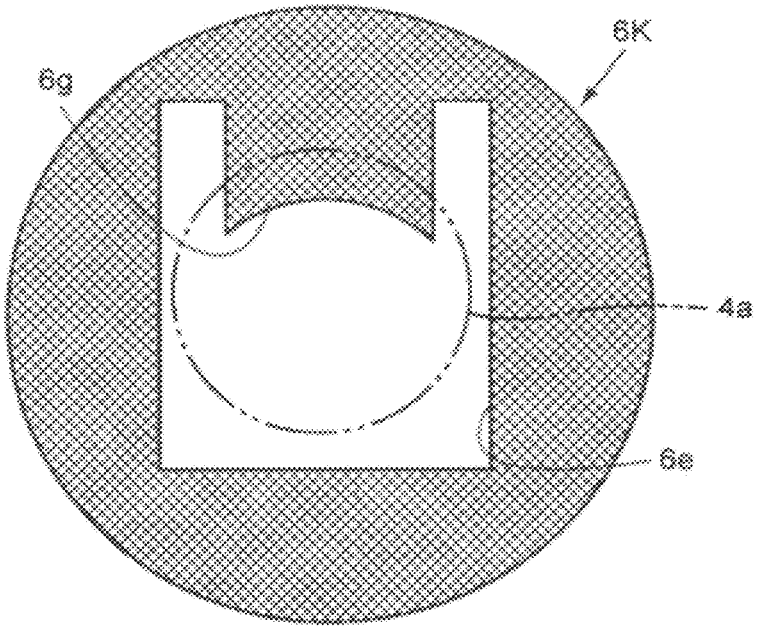
FIG. 27 is a front view showing still another modified example of the shape of the conductive cloth.

A conductive cloth 6K shown in FIG. 27 differs from the conductive cloth 6H shown in FIG. 25 only in that the conductive cloth 6K has a shape including a line contact region 6*g* instead of the contact region 6*f*; as shown in FIG. 27, the line contact region 6*g* enables the tip of the conductive cloth 6K to be nearly in line contact with the shaft 4 when the shaft 4 penetrates through the conductive cloth 6K.

The line contact region 6*g* is shaped so that the line contact region 6*g* follows the outline/peripheral shape of the shaft 4 when the shaft 4 penetrates through the conductive cloth 6K and is in line contact with the shaft 4. Consequently, in the conductive cloth 6K, an increase in contact area due to the line contact between the shaft 4 and the line contact region 6*g* and a crinkle due to forced deformation of the conductive cloth 6K when bending are suppressed; therefore, it is possible to ensure the stable conduction.

Besides the shapes of the conductive cloth shown in FIGS. 25 to 27, a combination of a slit and a cutout can be applied to the conductive cloth; the shape of the conductive cloth can be variously changed depending on the intended use.

The embodiments, including specific examples, are described above; however, technical contents disclosed herein are not limited to the above-described examples and embodiments, and it will be apparent to those skilled in the art that these embodiments and examples can be appropriately combined, and various embodiments, modified examples, and working examples according to the need, the purpose, the intended use, and the like can be achieved within the scope of the invention.

In the above embodiments and modified examples, there are described an electrification mechanism such as a grounding mechanism of a particular rotating body used in an electrophotographic image forming apparatus; needless to say, the present invention is not limited to this, and can be applied to a rotating body requiring electrification, such as a rotating body required to be grounded, in an electrophotographic image forming apparatus, an electrostatic-recording image forming apparatus, and a magnetic-recording image forming apparatus, etc. The "electrophotographic, electrostatic-recording, and magnetic-recording image forming apparatuses" here mean image forming apparatuses, such as a copier, a facsimile machine, a printer, a plotter, and a multi-function peripheral having a plurality of those functions, that perform an image forming process, such as an electrophotographic process, an electrostatic recording process, or a magnetic recording process, on an image carrier, such as an electrophotographic photoreceptor, an electrostatic recording dielectric, or a magnetic recording magnetic body, thereby forming a transferable image, such as a toner image, according to intended image information is on the image carrier, and transfers the transferable image onto a sheet-like recording medium, such as a transfer member, by means of an appropriate transfer unit, such as a transfer roller or a corona discharger, applied with a transfer bias.

According to the embodiment, it is possible to resolve the problems in the conventional technologies, and also possible to achieve and provide a new rotating-body electrification mechanism, an image carrier unit, process cartridge, and image forming apparatus using the rotating-body electrification mechanism, and a method for electrifying (grounding) an image carrier unit. Main effects of claims are as follows.

According to an embodiment, sliding between metals can be eliminated by the configuration described above; therefore, conduction failure can be prevented by suppression of generation of an abnormal sound and oxidation of metal. Furthermore, the contact state becomes stabilized, so conduction can be ensured without being influenced by conditions of use and storage. Moreover, it eliminates the need for conductive lubricant, so it is possible to provide an environmentally-friendly, inexpensive, compact mechanism for stable electrification of a rotating body.

According to an embodiment, by the above configuration, it is possible to achieve and provide an image carrier unit.

According to an embodiment, by the above configuration, it is possible to achieve and provide a simply-constructed, inexpensive, compact image carrier unit.

According to an embodiment, by the above configuration, it becomes easier to insert the shaft into the image carrier, and therefore, the workability in assembly of the image carrier can be enhanced.

According to an embodiment, by the above configuration, the conductive member can be prevented from getting stuck between the bearing and the shaft, and also deformation of the conductive member can be prevented; therefore, it is possible to ensure the stable conduction.

According to an embodiment, by the above configuration, contact pressure of the conductive member on the shaft is less likely to be affected by a dimension error of each component, and a decrease in pressure with time can be prevented; therefore, it is possible to ensure the stable conduction.

According to an embodiment, by the above configuration, a cloth-like or sheet-like conductive member (e.g., a conductive cloth) can be pressed against the shaft at contact pressure by the pressing member; therefore, the stable conduction can be ensured over time.

According to an embodiment, by the above configuration, the pressing member can double as the pushing member, so a cloth-like or sheet-like conductive member (e.g., a conductive cloth) can be held by the pressing member; therefore, the stable conduction can be ensured over time, and also it is possible to provide an inexpensive image carrier unit capable of ensuring the stable conduction.

According to an embodiment, it is possible to specify a conductive cloth to be mounted; therefore, it is possible to ensure the stable conduction.

According to an embodiment, it is possible to achieve and provide a method for electrifying an image carrier.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A mechanism for electrification of a rotating body used in an image forming apparatus, comprising:

a pressing member that is elastically-deformable;

an electrifying object that contacts an inner portion of the rotating body;

a conductive member that is a cloth or a sheet and includes a first portion and a second portion provided between the pressing member and the electrifying object along a longitudinal axis of the rotating body, wherein compression of the pressing member brings the first portion into contact with the electrifying object, and presses the second portion against a contact member that is conductive, wherein the contact member is one of a rotating shaft that rotates together with the rotating body, and a shaft that rotatably supports the rotating body, and wherein the first portion is in contact with the electrifying object, the second portion is in contact with the contact member, and conduction is provided between the rotating body and the contact member.

2. The rotating-body electrification mechanism according to claim 1, wherein the conductive member has at least any one of a slit and a cutout portion that enables the contact member to penetrate through the conductive member and enables the conductive member to bend and be in contact with the contact member when the contact member penetrates through the conductive member.

3. An image carrier unit comprising:

a rotating body including an image carrier with any one of an electrophotographic photosensitive layer, an electrostatic recording dielectric layer, and a magnetic recording magnetic layer on a cylindrical conductive base member;

a flange member that is fixed to at least one end of the image carrier; and a mechanism that electrifies the rotating body including:

a pressing member that is elastically-deformable, an electrifying object, and a conductive member that is a cloth or a sheet and is provided between the pressing member and the electrifying object, wherein compression of the pressing member brings a first portion of the conductive member into contact with the electrifying object and presses a second portion of the conductive member against a contact member that is conductive, wherein the conductive member has at least any one of a slit and a cutout portion that enables the contact member to penetrate through the conductive member and enables the conductive member to bend and be in contact with the contact member when the contact member penetrates through the conductive member, and wherein the electrifying object is a metal conductive member including a base end portion in contact with the conductive member and a tip portion fixed to an inner wall surface of the cylindrical conductive base member of the rotating body, wherein the pressing member, the conductive member, and the electrifying object are placed within the flange member, and the electrifying object is fixed to the inside of the flange member with the pressing member and the conductive member sandwiched between the electrifying object and the flange member, wherein the contact member is a shaft that penetrates through a center of the flange member, thereby rotatably supporting the image carrier, wherein the shaft is inserted into the electrifying object, the conductive member, the pressing member, and the flange member, thereby the conductive member bends and comes in contact with the shaft by compression of the pressing member, and the cylindrical conductive base member is connected to the shaft through contact between the electrifying object and the conductive member.

4. The image carrier unit according to claim 3, wherein the conductive member bends toward the inside of the flange member thereby being in contact with the shaft.

5. The image carrier unit according to claim 4, wherein the flange member has a contact holding portion having an inner wall surface in contact with a compressed portion of the pressing member when the conductive member is in contact with the shaft, and the compressed portion of the pressing member is housed and held between the shaft and the inner wall surface.

6. The image carrier unit according to claim 5, wherein a distance in a radial direction in the flange member from a center line of the shaft to the inner wall surface becomes gradually larger toward one end of the image carrier.

7. The image carrier unit according to claim 5, wherein the image carrier unit satisfies $L2<L1<L3$, where L1 denotes a distance from a center line of the shaft to the inner wall surface in the radial direction in the flange member, L2 denotes a distance from a mounting surface of the flange member on which the conductive member is mounted to a start edge of the inner wall surface in a length direction of the shaft, and L3 denotes a distance from the mounting surface on which the conductive member is mounted to an end edge of the inner wall surface in the length direction of the shaft.

8. The image carrier unit according to claim 3, wherein the pressing member has at least one portion where a compression ratio of thickness after elastic deformation to original thickness before the elastic deformation is more than 0 and does not exceed 0.7.

9. The image carrier unit according to claim 8, wherein the pressing member is a nonmetallic elastic body containing at least any one of rubber and sponge.

10. The image carrier unit according to claim 9, further comprising a pushing member that pushes the conductive member against the electrifying object, wherein the pressing member and the pushing member are configured to be integrated.

11. The image carrier unit according to claim 3, wherein the conductive member is a conductive cloth formed of a cloth-like material into which at least any one of polyethylene terephthalate fiber, nylon fiber, and polyester fiber, nickel, and copper are woven.

12. A process cartridge that integrally holds therein an image carrier and at least any one of a charging unit, a cleaning unit, and a developing unit and is removably attached to a main body of an image forming apparatus, the process cartridge comprising:

the image carrier unit according to claim 3.

13. An image forming apparatus comprising:

the process cartridge according to claim 12.

14. An image forming apparatus comprising:

the image carrier unit according to claim 3.

15. A method for electrifying an image carrier unit, the image carrier unit including:

an image carrier with any one of an electrophotographic photosensitive layer, an electrostatic recording dielectric layer, and a magnetic recording magnetic layer on a cylindrical conductive base member;

an insulating flange member fixed to at least one end of the image carrier;

a shaft that is conductive and penetrates through a center of the flange member, thereby rotatably supporting the image carrier;

a conductive member that is a cloth or a sheet and through which the shaft penetrates;

an electrifying object including a base end portion in contact with the conductive member and a tip portion that is fixed to an inner wall surface of the conductive member, and is configured to enable a contact member to penetrate therethrough without making contact; and a pressing member that is elastically-deformable and through which the shaft can penetrate, the method comprising:

placing the pressing member, the conductive member, and the electrifying object inside the flange member in that order from an inside of the flange member;

inserting the shaft into the electrifying object, the conductive member, the pressing member, and the flange member thereby bending the conductive member and also compressing the pressing member thereby bringing the conductive member into contact with the shaft; and connecting the conductive member to the shaft via contact between the electrifying object and the conductive member so as to be electrically conductive.

* * * * *